US010452004B2

(12) United States Patent
Takazawa

(10) Patent No.: US 10,452,004 B2
(45) Date of Patent: Oct. 22, 2019

(54) IMAGE FORMING APPARATUS REDUCING MEDIA SURFACE ROUGHNESS BEFORE FORMING A COLOR IMAGE PROTECTED BY TRANSPARENT TONER

(71) Applicant: Oki Data Corporation, Tokyo (JP)

(72) Inventor: Takayuki Takazawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/816,080

(22) Filed: Nov. 17, 2017

(65) Prior Publication Data

US 2018/0143571 A1 May 24, 2018

(30) Foreign Application Priority Data

Nov. 21, 2016 (JP) ..... 2016-226180

(51) Int. Cl.

| | |
|---|---|
| ***G03G 15/16*** | (2006.01) |
| ***G03G 15/23*** | (2006.01) |
| ***G03G 15/00*** | (2006.01) |
| ***G03G 15/36*** | (2006.01) |
| ***G03G 15/01*** | (2006.01) |

(52) U.S. Cl.

CPC ..... *G03G 15/1605* (2013.01); *G03G 15/1675* (2013.01); *G03G 15/1695* (2013.01); *G03G 15/235* (2013.01); *G03G 15/36* (2013.01); *G03G 15/6579* (2013.01); *G03G 15/6582* (2013.01); *G03G 15/6585* (2013.01); *G03G 15/6591* (2013.01); *G03G 15/0131* (2013.01); *G03G 15/0189* (2013.01); *G03G 15/6558* (2013.01); *G03G 2215/0129* (2013.01)

(58) Field of Classification Search

CPC ..... G03G 15/6585; G03G 15/6591; G03G 15/6582; G03G 15/6579; G03G 15/1695; G03G 15/235; G03G 15/1675; G03G 15/36; G03G 15/1605; G03G 15/0131; G03G 15/6558; G03G 15/0189; G03G 2215/0129

See application file for complete search history.

(56) References Cited

U.S. PATENT DOCUMENTS

| | | | | |
|---|---|---|---|---|
| 2008/0138121 | A1 | 6/2008 | Tamaki | |
| 2009/0297970 | A1 | 12/2009 | Tyagi et al. | |
| 2017/0045848 | A1* | 2/2017 | Tsuda | G03G 15/0126 |

FOREIGN PATENT DOCUMENTS

| | | | |
|---|---|---|---|
| AU | 2014200724 | B2 | 9/2015 |
| EP | 2348365 | A1 | 7/2011 |
| EP | 2500782 | A2 | 9/2012 |
| JP | 2006078883 | A * | 3/2006 |
| JP | 2006078883 | A | 3/2006 |

* cited by examiner

*Primary Examiner* — Joseph S Wong
(74) *Attorney, Agent, or Firm* — Panitch Schwarze Belisario & Nadel LLP

(57) ABSTRACT

An image forming apparatus includes an image forming section and a transfer section. The image forming section includes a first image forming unit that forms a first developer image and a second image forming unit that forms a second developer image. The transfer section transfers, on a basis of a first transfer condition, the first developer image onto a medium, and transfers, on a basis of a second transfer condition, the second developer image onto the medium onto which the first developer image has been transferred. The second transfer condition is different from the first transfer condition.

8 Claims, 8 Drawing Sheets

IMAGE FORMING APPARATUS REDUCING MEDIA SURFACE ROUGHNESS BEFORE FORMING A COLOR IMAGE PROTECTED BY TRANSPARENT TONER

CROSS REFERENCE TO RELATED APPLICATIONS

The present application claims priority from Japanese Patent Application No. 2016-226180 filed on Nov. 21, 2016, the entire contents of which are hereby incorporated by reference.

BACKGROUND

The technology relates to an image forming apparatus that forms a developer image on a medium.

In general, when an image forming apparatus of an electrophotography scheme forms an image on a medium having relatively-great surface roughness, it may be difficult to fill a concave part of the medium with a developer in some cases. This may lead to degradation of image quality. To address this, it has been proposed a technique that forms a colored toner image after forming an image such as a white toner image and a transparent toner image on a surface of the medium, for example, as disclosed in Japanese Unexamined Patent Application Publication No. 2006-78883.

SUMMARY

It is desired to form an image with higher quality even on a medium having further greater surface roughness.

It is desirable to provide an image forming apparatus that is able to form an image having higher quality on a medium having greater irregularities.

According to one embodiment of the technology, there is provided an image forming apparatus including: an image forming section including a first image forming unit that forms a first developer image and a second image forming unit that forms a second developer image; and a transfer section that transfers, on a basis of a first transfer condition, the first developer image onto a medium, and transfers, on a basis of a second transfer condition, the second developer image onto the medium onto which the first developer image has been transferred, in which the second transfer condition is different from the first transfer condition.

According to one embodiment of the technology, there is provided an image forming apparatus including: an image forming section including a first image forming unit that forms a first developer image and a second image forming unit that forms a second developer image; a transfer section that transfers the first developer image onto a medium and transfers the second developer image onto the medium onto which the first developer image has been transferred; and a fixing section that fixes, on a basis of a first fixing condition, the first developer image to the medium after the transfer section has transferred the first developer image onto the medium and before the transfer section transfers the second developer image onto the medium, and fixes, on a basis of a second fixing condition, the second developer image to the medium after the transfer section has transferred the second developer image onto the medium, in which the second fixing condition being different from the first fixing condition.

According to one embodiment of the technology, there is provided an image forming apparatus including: an image forming section that performs a first image forming operation and a second image forming operation, in which the first image forming operation forms a first developer image, the second image forming operation sequentially forms a second developer image and a third developer image after the first image forming operation has been performed, the first developer image is a first transparent image or a white image, the second developer image is a second transparent image, and the third developer image is a colored image; and a transfer section that performs a first transfer operation and a second transfer operation, in which the first transfer operation transfers the first developer image onto a medium before the image forming section performs the second image forming operation, and the second transfer operation transfers the third developer image and the second developer image onto the first developer image having been transferred onto the medium to allow the third developer image and the second developer image to be stacked in order on the first developer image having been transferred onto the medium.

DETAILED DESCRIPTION

Some example embodiments of the technology are described below in detail with reference to the accompanying drawings. It is to be noted that the description below refers to mere specific examples of the technology, and the technology is therefore not limited thereto. Further, the technology is not limited to factors such as arrangements, dimensions, and dimension ratios of components illustrated in the respective drawings.

The elements in the following example embodiments which are not recited in a most-generic independent claim of the technology are optional and may be provided on an as-needed basis. The description is given in the following order.

1. First Example Embodiment (An example of an image forming apparatus that transfers a transparent image onto a medium at a first transfer voltage, and thereafter transfers a colored image at a second transfer voltage to thereby allow the transparent image that has been transferred onto the medium to be overlaid with the colored image)

2. Second Example Embodiment (An example of an image forming apparatus that transfers a first transparent image onto the medium, and thereafter further transfers the colored image and a second transparent image to thereby allow the first transparent image that has been transferred onto the medium to be overlaid with the colored image and the second transparent image)

3. Third Example Embodiment (An example of an image forming apparatus that transfers the first transparent image onto the medium at the first transfer voltage, and thereafter transfers the colored image and the second transparent image at the second transfer voltage to allow the first transparent image that has been transferred onto the medium to be overlaid with the colored image and the second transparent image)

4. Experimental Examples

5. Other Modification Examples

1. First Example Embodiment

[1-1. Configuration of Image Forming Apparatus]

Figure 1:
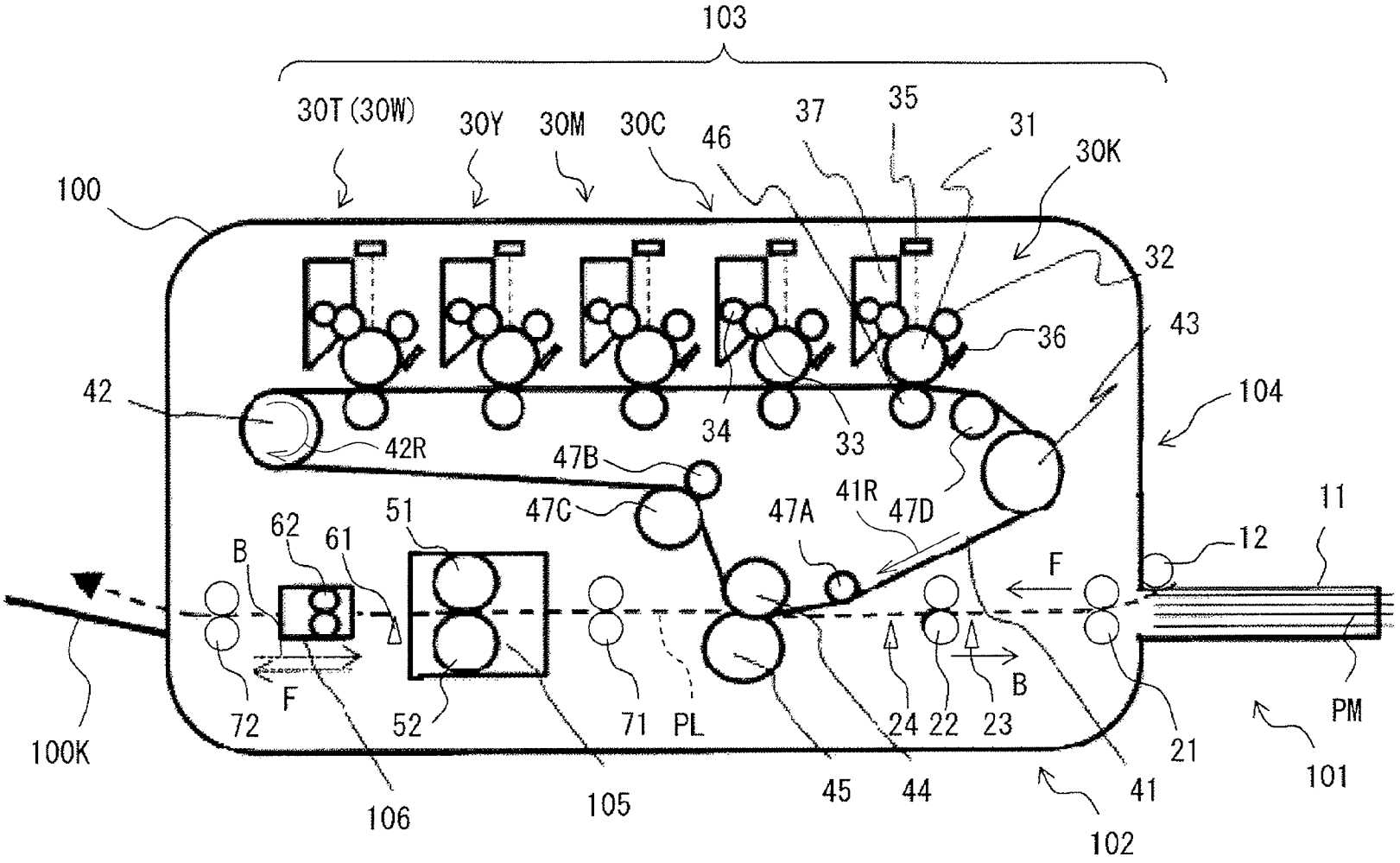
FIG. 1 schematically illustrates an example of an overall configuration of an image forming apparatus according to a first example embodiment of the technology.
Figure 2:
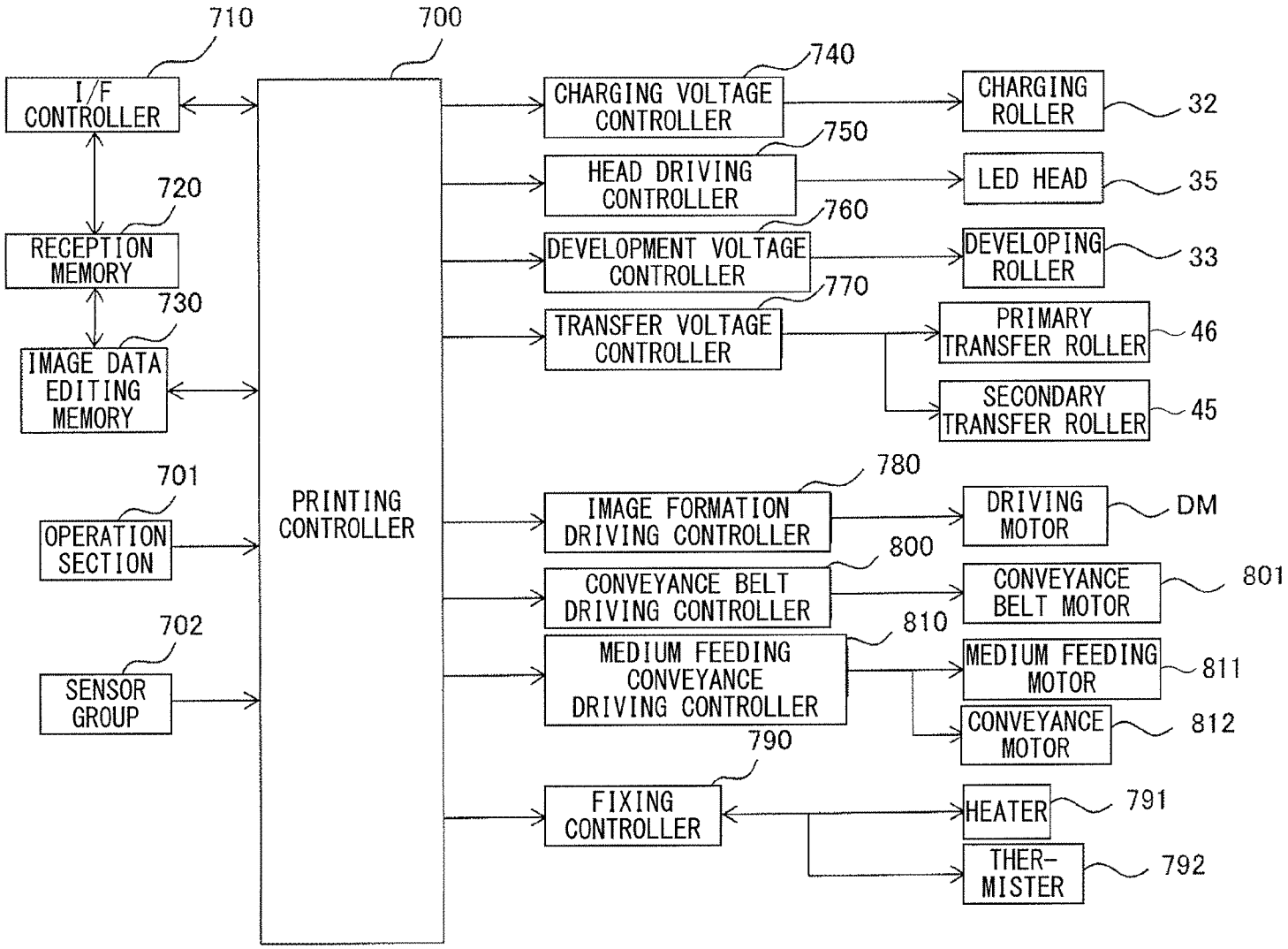
FIG. 2 is a block diagram schematically illustrating an example of an internal configuration of an image forming apparatus illustrated in FIG. 1.

FIG. 1 schematically illustrates an example of an overall configuration of an image forming apparatus according to a first example embodiment of the technology. FIG. 2 is a block diagram illustrating an example of a configuration of a control mechanism of the image forming apparatus. The image forming apparatus may correspond to an "image forming apparatus" in one specific but non-limiting embodiment of the technology. The image forming apparatus according to the first example embodiment may be a printer that forms, using an electrophotography scheme, an image such as a color image on a medium PM such as a sheet and a film that is to be subjected to printing, for example. Non-limiting examples of the medium PM may include a resin film in addition to a sheet having relatively-high heat resistance such as plain paper. Non-limiting examples of the resin film may include a polyethylene (PE) film, a polypropylene (PP) film, a polyvinyl chloride (PVC) film, and a polyethylene terephthalate (PET) film.

Referring to FIG. 1, the image forming apparatus may include, for example, inside a housing 100, a medium feeding section 101, a medium conveying section 102, an image forming section 103, a transfer section 104, a fixing section 105, and a discharging section 106. A placement tray 100K may be provided outside the housing 100 at a position corresponding to the discharging section 106. The placement tray 100K may be a tray on which the medium PM formed with an image is to be placed. In the image forming apparatus, the medium PM may be conveyed along a conveyance path PL illustrated by a dashed line from the medium feeding section 101 toward the placement tray 100K from the right side to the left side of the paper plane of FIG. 1. It is to be noted that, herein, a direction from any point toward the medium feeding section 101 or a position that is closer to the medium feeding section 101 than any point is referred to as "upstream" of the point. A direction from any point toward the placement tray 100K or a position that is closer to the placement tray 100K than any point is referred to as "downstream" of the point.

[Medium Feeding Section 101]

The medium feeding section 101 may include a medium cassette (medium feeding tray) 11 and a medium feeding roller 12, for example. The medium cassette 11 may contain a plurality of media PM in a stacked manner. The medium feeding roller 12 may pick up the media PM one by one from the medium cassette 11, and sequentially feed the media PM picked up to the medium conveying section 102 one by one. The medium feeding roller 12 may be rotated by a medium feeding motor 811 on the basis of an instruction given by a printing controller 700. The medium feeding motor 811 may be controlled by a medium feeding conveyance driving controller 810.

[Medium Conveying Section 102]

The medium conveying section 102 may include a pair of conveying rollers 21, a position sensor 23, a pair of conveying rollers 22, and a position sensor 24 in order from the upstream, for example. Each of the position sensors 23 and 24 may detect a position of the medium PM that travels on the conveyance path PL. The pair of conveying rollers 21 and the pair of conveying rollers 22 may convey the medium PM fed from the medium feeding roller 12 toward a secondary transfer section that is located downstream of the pair of conveying rollers 21 and the pair of conveying rollers 22. The secondary transfer section will be described later in greater detail.

[Image Forming Section 103]

The image forming section 103 may form a toner image (a developer image). The image forming section 103 may include five image forming units, i.e., image forming units 30T, 30Y, 30M, 30C, and 30K, for example. The image forming units 30T, 30Y, 30M 30C, and 30K may basically have respective configurations that are the same as each other except that the image forming units 30T, 30Y, 30M, 30C, and 30K may form respective toner images by the use of toners having respective colors that are different from each other. Specifically, the image forming unit 30T may form a transparent toner image by the use of a transparent (T) toner. The image forming unit 30Y may form a yellow toner image by the use of a yellow (Y) toner. The image forming unit 30M may form a magenta toner image by the use of a magenta (M) toner. The image forming unit 30C may form a cyan toner image by the use of a cyan (C) toner. The image forming unit 30K may form a black toner image by the use of a black (K) toner. In this example, the transparent toner image may correspond to any of a "first developer image", a "first transparent image", and a "second transparent image" in respective specific but non-limiting embodiments of the technology. In contrast, each of the yellow toner image, the magenta toner image, the cyan toner image, and the black toner image may correspond to any of a "second developer image" and a "colored image" in respective specific but non-limiting embodiments of the technology. It is to be noted that, when the medium PM is white, the image forming section 103 may include, instead of the image forming unit 30T, an image forming unit 30W that forms a white toner image by the use of a white (W) toner. The white toner image may correspond to any of the "first developer image" and a "white image" in respective specific but non-limiting embodiments of the technology. Alternatively, when the medium PM is of another color, i.e., a color other than white, the image forming section may include, instead of the image forming unit 30T, an image forming unit that forms a toner image of a color that is the same as the color of the medium PM.

Each of the foregoing toners may include agents such as a predetermined coloring agent, a predetermined release agent, a predetermined electric charge control agent, and a predetermined treatment agent, for example. Components of the respective agents described above may be mixed as appropriate or subjected to a surface treatment. Each of the toners may be thus manufactured. The coloring agent, the release agent, and the electric charge control agent of the foregoing agents may serve as internal additives. Further, in one example embodiment, each of the toners may include an external additive such as silica and titanium oxide, and binding resin such as polyester resin.

As the coloring agent used for each of the yellow toner, the magenta toner, the cyan toner, and the black toner, an agent such as a dye and a pigment may be used solely, or a plurality of agents such as the dye and the pigment may be used in any combination. Specific but non-limiting examples of such a coloring agent may include carbon black, iron oxide, permanent brown FG, pigment green B, pigment blue 15:3, solvent blue 35, solvent red 49, solvent red 146, quinacridone, carmine 6B, naphtol, disazo yellow, and isoindoline. Specific but non-limiting coloring agent used for the white toner may include titanium oxide and calcium carbonate. It is to be noted that the transparent toner may not include any coloring agent such as a pigment, and may become colorless and transparent after the transparent toner is fixed.

The image forming unit 30T that forms the transparent toner image or the image forming unit 30W that forms the white toner image may be provided at the most upstream position of the positions of the respective image forming units 30T or 30W, 30Y, 30M, 30C, and 30K. The image forming unit 30Y, the image forming unit 30M, the image forming unit 30C, and the image forming unit 30K may be disposed in order from the upstream toward the downstream, at positions that are located downstream of the image forming unit 30T or 30W. In this example, the image forming unit 30T or 30W may correspond to a "first image forming unit" in one specific but non-limiting embodiment of the technology. Each of the image forming units 30Y, 30M, 30C, and 30K may correspond to a "second image forming unit" in one specific but non-limiting embodiment of the technology.

Each of the image forming units 30T or 30W, 30K, 30Y, 30M, and 30C may include a photosensitive drum 31, a charging roller 32, a developing roller 33, a feeding roller 34, a light-emitting diode (LED) head 35, a blade 36, and a toner tank 37, for example.

The photosensitive drum 31 may have a substantially-cylindrical appearance and has a surface (a surficial part) supporting an electrostatic latent image. The photosensitive drum 31 may include a photoreceptor such as an organic photoreceptor. Specifically, the photosensitive drum 31 may include an electrically-conductive supporting body and a photoconductive layer that covers an outer circumferential part (a surface) of the electrically-conductive supporting body, for example. The electrically-conductive supporting body may include a metal pipe including aluminum, for example. The photoconductive layer may have a structure including an electric charge generation layer and an electric charge transfer layer that are stacked in order, for example. The foregoing photosensitive drum 31 may be caused to rotate at a predetermined circumferential velocity by a driving motor DM illustrated in FIG. 2. In the example illustrated in FIG. 1, the photosensitive drum 31 may rotate anticlockwise. Referring to FIG. 2, the driving motor DM may be controlled by an image formation driving controller 780 on the basis of an instruction given by the printing controller 700.

The charging roller 32 may have a substantially-columnar appearance and electrically charge the surface (the surficial part) of the photosensitive drum 31. The charging roller 32 may be so disposed that a circumferential surface of the charging roller 32 is in contact with a surface (a circumferential surface) of the photosensitive drum 31. The charging roller 32 may include a metal shaft and an electrically-semiconductive rubber layer that covers an outer circumferential part (a surface) of the metal shaft, for example. Non-limiting examples of the electrically-semiconductive rubber layer may include an electrically-semiconductive epichlorohydrin rubber layer. It is to be noted that, in the example illustrated in FIG. 1, the charging roller 32 may rotate clockwise, i.e., in a direction opposite to a rotation direction of the photosensitive drum 31. Further, a charging voltage of the charging roller 32 may be controlled by a charging voltage controller 740 on the basis of an instruction given by the printing controller 700, as illustrated in FIG. 2.

The developing roller 33 may have a substantially-columnar appearance and have a surface supporting the toner that develops the electrostatic latent image. The developing roller 33 may be so disposed as to be in contact with the surface (the circumferential surface) of the photosensitive drum 31. The developing roller 33 may include a metal shaft and an electrically-semiconductive urethane rubber layer that covers an outer circumferential part (a surface) of the metal shaft, for example. The developing roller 33 may rotate at a predetermined circumferential velocity. In the example illustrated in FIG. 1, the developing roller 33 may rotate clockwise, i.e., in a direction opposite to the rotation direction of the photosensitive drum 31. Further, a development voltage of the developing roller 33 may be controlled by a development voltage controller 760 on the basis of an instruction given by the printing controller 700, as illustrated in FIG. 2.

The feeding roller 34 may have a substantially-columnar appearance and feed the toner to the developing roller 33. The feeding roller 34 may be so disposed as to be in contact with a surface (a circumferential surface) of the developing roller 33. The feeding roller 34 may include a metal shaft and a foamed silicone rubber layer that covers an outer circumferential part (a surface) of the metal shaft, for example. It is to be noted that, in the example illustrated in FIG. 1, the feeding roller 34 may rotate clockwise, i.e., in a direction same as a rotation direction of the developing roller 33.

The LED head 35 may perform exposure on the surface (the surficial part) of the photosensitive drum 31, and thereby form an electrostatic latent image on the surface (the surficial part) of the photosensitive drum 31. The LED head 35 may include a light source that emits application light, and a lens array that performs imaging of the application light on the surface (the surficial part) of the photosensitive drum 31, for example. The light source that emits the application light may be a light-emitting diode, for example. Further, an operation of the LED head 35 may be controlled by a head driving controller 750 on the basis of an instruction given by the printing controller 700, as illustrated in FIG. 2.

The blade 36 may be a cleaning member that scrapes and recovers the toner remained on the surface (the surficial part) of the photosensitive drum 31 to thereby clean the surface of the photosensitive drum 31. The blade 36 may be so disposed as to be in contact with the surface of the photosensitive drum 31 in a counter direction. In other words, the blade 36 may be so disposed as to protrude in a direction opposite to the rotation direction of the photosensitive drum 31. The blade 36 may include an elastic material such as polyurethane rubber, for example. The toner tank 37 may be a container that contains the toner, and have a toner discharging opening at a lower part of the toner tank 37.

[Transfer Section 104]

The transfer section 104 may transfer, onto the medium PM, the toner image formed in the image forming section 103. The transfer section 104 may include an intermediate transfer belt 41, a driving roller 42, a driven roller 43, a backup roller 44, a secondary transfer roller 45, a plurality of primary transfer rollers 46, and conveying rollers 47A to 47D.

The intermediate transfer belt 41 may be an endless elastic belt including a base member, an elastic layer provided on a surface of the base member, and a coating layer that covers the elastic layer, for example. The base member may include a material such as a resin material. The elastic layer may include a material such as urethane rubber. In one example embodiment, the base member of the intermediate transfer belt 41 may allow modification of the base member upon circular rotation which will be described later to fall within a certain range. For example, in one example embodiment, the base member of the intermediate transfer belt 41 may have a Young's modulus of about 2000 Mpa or greater. In another example embodiment, the base member of the intermediate transfer belt 41 may have a Young's modulus of about 3000 Mpa or greater. Specific but non-limiting examples of the constituent material of the base member of the intermediate transfer belt 41 may include resin such as polyimide (PI), polyamideimide (PAI), polyetherimide (PEI), polyphenylenesulfide (PPS), polyetheretherketone (PEEK), polyvinylidenedifluoride (PVDF), polyamide (PA), polycarbonate (PC), and polybutylene terephthalate (PBT). It is to be noted that any of the foregoing resin materials may be used solely, or any of the foregoing resin materials may be used in mixture. Further, in one example embodiment, carbon black may be added to the base member as an electrically-conducting agent. As the carbon black, any of materials such as furnace black, channel black, Ketjen black, and acetylene black may be used solely, or any of the foregoing materials may be used in mixture. In one example embodiment, the furnace black, the channel black, or both may be used to obtain a predetermined resistance. Depending on the use of the carbon black, carbon black subjected to an oxidation degradation prevention treatment such as an oxidation treatment and a graft treatment or carbon black with improved dispersibility to a solvent may be used. In particular, in one example of the present example embodiment, the content of the carbon black in the base member may be from about 3 wt % to about 40 wt % both inclusive in terms of securing of mechanical strength. In another example of the present example embodiment, the content of the carbon black in the base member may be from about 3 wt % to about 30 wt % both inclusive in terms of securing of mechanical strength. It is to be noted that a method of providing electric conductivity is not limited to an electronic conducting method utilizing a material such as carbon black. Alternatively, an ion conducting agent may be added. Further, the material of the elastic layer is not limited to urethane rubber. Alternatively, the elastic layer may include an elastic body such as chloroprene rubber, silicone rubber, and butadiene rubber. When the elastic layer includes the elastic body such as chloroprene rubber, silicone rubber, and butadiene rubber, the elastic body may have rubber hardness of Shore 70A or lower in one example embodiment, and may have rubber hardness of Shore 60A or lower in another example embodiment, in terms of improvement in adherence to the medium PM. In the first example embodiment, the elastic layer may be provided with electric conductivity by adding the ion conducting agent to urethane rubber. Carbon black may be added to the elastic layer as with the base member, however, the addition of the carbon black may possibly increase the rubber hardness of the urethane rubber in some cases. In contrast, when the ion conducting agent is added to the elastic layer, such an increase in rubber hardness is suppressed, and an effect of reducing variations in electric resistance value in the intermediate transfer belt 41 as a whole may be also expectable. In one example embodiment, the coating layer may include urethane having low hardness ($E_IT \leq 3$ GPa) to avoid loss of elasticity of the elastic layer. In one example embodiment, the coating layer may have high releasing properties for the toner image upon the secondary transfer or upon cleaning. Accordingly, for example, a water repellent agent containing fluorine may be added to the urethane resin. The surface energy of the coating layer may be thereby decreased. The foregoing intermediate transfer belt 41 may lie on the driving roller 42, the driven roller 43, the backup roller 44, and the conveying rollers 47A to 47D, while being stretched. It is to be noted that the intermediate transfer belt 41 may correspond to an "intermediate transfer member" in one specific but non-limiting embodiment of the technology.

The driving roller 42 may be caused to rotate clockwise in a direction indicated by an arrow 42R illustrated in FIG. 1 by driving force transmitted from a conveyance belt motor 801 illustrated in FIG. 2. Further, the driving roller 42 may cause the intermediate transfer belt 41 to rotate circularly in a direction indicated by an arrow 41R. An operation of the conveyance belt motor 801 may be controlled by a conveyance belt driving controller 800 on the basis of an instruction given by the printing controller 700, as illustrated in FIG. 2. The driving roller 42 may be located upstream of the image forming units 30T (30W), 30Y, 30M, 30C, and 30K in a direction in which the intermediate transfer belt 41 is to be conveyed. The driven roller 43 may be rotated in accordance with the rotation of the driving roller 42.

Each of the plurality of primary transfer rollers 46 may electrostatically transfer, onto the intermediate transfer belt 41, the toner image formed in corresponding one of the image forming units 30T (30W), 30Y, 30M, 30C, and 30K. Each of the primary transfer rollers 46 may be disposed at a position corresponding to corresponding one of the image forming units 30T (30W), 30Y, 30M, 30C, and 30K with the intermediate transfer belt 41 in between. The primary transfer rollers 46 may configure a primary transfer section together with the photosensitive drums 31. Each of the primary transfer rollers 46 may include a material such as a foamed electrically-semiconductive elastic rubber material. Further, each of the primary transfer rollers 46 may receive a predetermined transfer voltage from a transfer voltage controller 770. The transfer voltage to be applied to each of the primary transfer rollers 46 may be controlled by the transfer voltage controller 770 on the basis of an instruction given by the printing controller 700, as illustrated in FIG. 2, for example.

The secondary transfer roller 45 and the backup roller 44 may face each other and sandwich the intermediate transfer belt 41 in between. The backup roller 44 and the secondary transfer roller 45 may configure a secondary transfer section that transfers, onto the medium PM, the toner image on the surface of the intermediate transfer belt 41. The secondary transfer roller 45 may include a metal core member and an elastic layer that winds around an outer circumferential surface of the core member, for example. The elastic layer may be a foamed rubber layer, for example. The secondary transfer roller 45 may be biased toward the backup roller 44. The secondary transfer roller 45 may be thereby pressed against the backup roller 44 with the intermediate transfer belt 41 in between. A predetermined transfer pressure may be thereby applied to the medium PM that passes through the secondary transfer section.

The backup roller 44 and the secondary transfer roller 45 may transfer, onto the medium PM fed from the pair of conveying rollers 22, the toner image on the surface of the intermediate transfer belt 41. In other words, the backup roller 44 and the secondary transfer roller 45 may perform secondary transfer. Upon the secondary transfer, the secondary transfer roller 45 may receive a transfer bias (a direct-current voltage). This may provide a potential difference between the secondary transfer roller 45 and the backup roller 44, which causes the toner image to be transferred onto the medium PM. The secondary transfer roller 45 may receive a predetermined transfer voltage from the transfer voltage controller 770. The transfer voltage to be applied to the secondary transfer roller 45 may be controlled by the transfer voltage controller 770 on the basis of an instruction given by the printing controller 700, as illustrated in FIG. 2, for example.

When the image forming apparatus does not form any colored image (the yellow toner image, the magenta toner image, the cyan toner image, and the black toner image), and forms only the white image (the white toner image) by the image forming unit 30W or forms only the transparent image (the transparent toner image) by the image forming unit 30T, the primary transfer roller 46 in each of the image forming units 30Y, 30M, 30C, and 30K that form the colored image may be moved to a position away from the intermediate transfer belt 41, in one example embodiment. One reason for this is that this avoids damage on the white image or the transparent image formed on the intermediate transfer belt 41.

[Fixing Section 105]

The fixing section 105 may apply heat and pressure to the toner image transferred onto the medium PM conveyed from the transfer section 104, and thereby fix the toner image onto the medium PM. The fixing section 105 may include a fixing roller 51 illustrated in FIG. 1, a pressure-applying roller 52 illustrated in FIG. 1, a heater 791 illustrated in FIG. 2 that is built in the fixing roller 51, and a thermistor 792 illustrated in FIG. 2. The fixing section 105 may be controlled by the fixing controller 790 on the basis of an instruction given by the printing controller 700, for example. Further, the fixing section 105 may be so configured that a predetermined current is fed to the heater 791, for example. Further, the pressure-applying roller 52 may be biased toward the fixing roller 51. The pressure-applying roller 52 may be thereby pressed against the fixing roller 51. This may apply a predetermined fixing pressure, i.e., a nip pressure, to the medium PM that passes through the fixing section 105.

[Discharging Section 106]

The discharging section 106 may include a position sensor 61 and a pair of conveying rollers 62 that face each other. The position sensor 61 may detect the position of the medium PM that is discharged from the fixing section 105 and travels on the conveyance path PL. The pair of conveying rollers 62 may be caused to rotate by driving force of a conveyance motor 812 illustrated in FIG. 2, and convey the medium PM discharged from the fixing section 105 toward the placement tray 100K provided outside the housing 100. The conveyance motor 812 may be controlled by the medium feeding conveyance driving controller 810 on the basis of an instruction given by the printing controller 700. Further, the pair of conveying rollers 62 may be also caused to rotate reversely by the control performed by the medium feeding conveyance driving controller 810 on the basis of an instruction given by the printing controller 700. Specifically, after the printing controller 700 confirms, by means of the position sensor 61, that the medium PM has been once discharged from the fixing section 105, the pair of conveying rollers 62 may convey the medium PM toward the fixing section 105 that is located upstream of the pair of conveying rollers 62 again.

It is to be noted that, in one example embodiment, the image forming apparatus may include a pair of conveying rollers 71 between the fixing section 105 and the secondary transfer section that is a part at which the backup roller 44 and the secondary transfer roller 45 face each other. The pair of conveying rollers 71 may be also able to be switched between a forward rotation operation that conveys the medium PM from the upstream toward the downstream and a reverse rotation operation that conveys the medium PM from the downstream toward the upstream. Similarly, each of the pairs of the conveying rollers 21 and 22 may be also able to be switched between a forward rotation operation that conveys the medium PM from the upstream toward the downstream and a reverse rotation operation that conveys the medium PM from the downstream toward the upstream. The foregoing operations of the respective conveying rollers 21, 22, and 71 may be also executed on the basis of an instruction given by the printing controller 700. Accordingly, in the image forming apparatus, the medium PM that has once passed through the fixing section 105 may be able to be reversed to the upstream of the secondary transfer section, and to sequentially pass through the secondary transfer section and the fixing section 105 again. In one example embodiment, however, when the medium PM is conveyed from the downstream toward the upstream, the fixing roller 51 and the pressure-applying roller 52 may be separated away from each other in the fixing section 105, and the backup roller 44 and the secondary transfer roller 45 may be separated away from each other in the secondary transfer section. One reason for this is that this avoids damage on the medium PM.

The image forming apparatus may further include a pair of conveying rollers 72 downstream of the discharging section 106. The image forming apparatus may discharge, with the pair of conveying rollers 72, the medium PM discharged from the fixing section 105 toward the placement tray 100K provided outside the housing 100.

[1-2. Configuration of Control Mechanism, Etc.]

A description is given below of a control mechanism of the image forming apparatus according to the first example embodiment, with reference to FIG. 2 in addition to FIG. 1. Referring to FIG. 2, the image forming apparatus may include the printing controller 700, an interface (I/F) controller 710, a reception memory 720, an image data editing memory 730, an operation section 701, and a sensor group 702. The image forming apparatus may further include the charging voltage controller 740, the head driving controller 750, the development voltage controller 760, the transfer voltage controller 770, the image formation driving controller 780, the fixing controller 790, the conveyance belt driving controller 800, and the medium feeding conveyance driving controller 810, each of which receives an instruction from the printing controller 700.

The printing controller 700 may include components such as a microprocessor, a read-only memory (ROM), a random access memory (RAM), and an input-output port. The printing controller 700 may control a process operation of the image forming apparatus as a whole by executing a predetermined program, for example. Specifically, the printing controller 700 may receive, for example, print data and a control command from the I/F controller 710, and perform a general control of the charging voltage controller 740, the head driving controller 750, the development voltage controller 760, the transfer voltage controller 770, the image formation driving controller 780, the fixing controller 790, the conveyance belt driving controller 800, and the medium feeding conveyance driving controller 810, to thereby perform a printing operation.

The I/F controller 710 may receive, for example, print data and a control command from an external device such as a personal computer (PC), and transmit a signal related to a state of the image forming apparatus.

The reception memory 720 may temporarily store the print data received from the external device such as the PC via the I/F controller 710.

The image data editing memory 730 may receive the print data stored in the reception memory 720, and store image data derived from editing of the received print data.

The operation section 701 may include components such as an LED lamp that is directed to displaying information such as a state of the image forming apparatus, and an input section that is directed to user's giving instruction to the image forming apparatus. Non-limiting examples of the input section may include a button and a touch panel.

The sensor group 702 may include various sensors that monitor an operation state of the image forming apparatus. Non-limiting examples of the various sensors may include a position sensor that detects the position of the medium PM, a temperature sensor that detects a temperature inside the image forming apparatus, and a print density sensor.

In response to the instruction given by the printing controller 700, the charging voltage controller 740 may apply the charging voltage to each of the charging rollers 32 and so perform a control that the surface of each of the photosensitive drums 31 is electrically charged.

The head driving controller 750 may perform a control of an exposure operation performed by each of the LED heads 35 in accordance with the image data stored in the image data editing memory 730.

In response to the instruction given by the printing controller 700, the development voltage controller 760 may apply the development voltage to each of the developing rollers 33, and so perform a control that the toner is developed on the electrostatic latent image formed on the surface of each of the photosensitive drums 31.

In response to the instruction given by the printing controller 700, the transfer voltage controller 770 may apply the predetermined transfer voltage to each of the primary transfer rollers 46 and the secondary transfer roller 45, and so perform a control that the toner images are transferred onto the intermediate transfer belt 41 or the medium PM.

In response to the instruction given by the printing controller 700, the image formation driving controller 780 may perform a driving control of the driving motor DM. The driving motor DM may perform rotation driving of each of the photosensitive drums 31, the charging rollers 32, and the developing rollers 33.

In response to the instruction given by the printing controller 700, the fixing controller 790 may control a fixing operation performed by the fixing section 105. Specifically, the fixing controller 790 may perform a control of a voltage to be applied to the heater 791. The fixing controller 790 may perform an ON-OFF control of the voltage to be applied to the heater 791, on the basis of the temperature of the fixing section 105 measured by the thermistor 792.

In response to the instruction given by the printing controller 700, the conveyance belt driving controller 800 may perform an operation control of the conveyance belt motor 801 provided in the image forming apparatus. The conveyance belt motor 801 may transmit driving force to the driving roller 42, and thereby perform driving of the intermediate transfer belt 41.

In response to the instruction given by the printing controller 700, the medium feeding conveyance driving controller 810 may perform an operation control of the medium feeding motor 811 and the conveyance motor 812 provided in the image forming apparatus. The medium feeding motor 811 may drive the medium feeding roller 12, for example. The conveyance motor 812 may drive the pairs of conveying rollers 21, 22, 62, 71, and 72, for example.

[1-3. Example Workings and Example Effects]

[A. Basic Operation of Image Forming Apparatus]

The image forming apparatus may form the toner image on the medium PM as follows. It is to be noted that the image forming apparatus may perform transfer and fixation of the white toner image or the transparent toner image onto the medium PM, and may thereafter so perform transfer and fixation of the colored image that the white toner image or the transparent toner image that has been formed on the medium PM is overlaid with the colored image. In other words, an image forming operation may be repeatedly performed twice on the single medium PM.

Specifically, first, when the print image data and a printing order are inputted to the printing controller 700 of the activated image forming apparatus from an external device via the I/F controller 710, the printing controller 700 may start a printing operation of the print image data, in association with sections such as the image formation driving controller 780, in response to the inputted printing order.

When the printing operation is started, the image formation driving controller 780 may drive the driving motor DM on the basis of the instruction given by the printing controller 700, and cause each of the photosensitive drums 31 to rotate in a predetermined rotation direction at a constant velocity. When each of the photosensitive drums 31 rotates, driving force derived from the rotation of the photosensitive drum 31 may be transmitted to corresponding one of the feeding rollers 34, corresponding one of the developing rollers 33, and corresponding one of the charging rollers 32, via a driving transmitter such as a gear train. As a result, each of the feeding rollers 34, the developing rollers 33, and the charging rollers 32 may rotate in the predetermined direction.

Further, the conveyance belt driving controller 800 may drive the conveyance belt motor 801, and thereby start the rotation of the intermediate transfer belt 41, on the basis of the instruction given by the printing controller 700. Further, the charging voltage controller 740 may apply a predetermined voltage to each of the charging rollers 32, and thereby electrically charge the surface of corresponding one of the photosensitive drums 31 evenly, on the basis of the instruction given by the printing controller 700.

Thereafter, the printing controller 700 may give an instruction to the head driving controller 750, and thereby start an exposure control. The head driving controller 750 may generate an exposure control signal on the basis of the instruction given by the printing controller 700, and may transmit the generated exposure control signal to each of the LED heads 35. Each of the LED heads 35 may apply, to corresponding one of the photosensitive drums 31, light corresponding to a color component of the printing image at timing designated by the exposure control signal, and thereby form an electrostatic latent image on the surface of the photosensitive drum 31.

Each of the developing rollers 33 may attach the developer to the electrostatic latent image on each of the photosensitive drums 31 and thereby form a toner image. The predetermined transfer voltage may be applied to each of the primary transfer rollers 46 by the transfer voltage controller 770. Further, the first transfer section in which the primary transfer rollers 46 and the photosensitive drums 31 sandwich the intermediate transfer belt 41 in between sequentially transfer, onto the surface of the intermediate transfer belt 41, the toner images on the respective photosensitive drums 31, to thereby allow the toner images to be overlaid with each other. It is to be noted that, upon the image forming operation for the first time, only the transparent toner image or only the white toner image may be transferred onto the surface of the intermediate transfer belt 41.

Thereafter, the medium feeding conveyance driving controller 810 may activate the medium feeding motor 811 and the conveyance motor 812 both illustrated in FIG. 2, and start conveyance of the medium PM, on the basis of the instruction given by the printing controller 700. This conveyance control may cause the medium PM to be conveyed toward the secondary transfer section at a predetermined conveyance speed. Specifically, referring to FIG. 1, first, the medium PM contained in the medium cassette 11 may be picked up by the medium feeding roller 12 one by one from the top, and be fed toward the pair of conveying rollers 21. The medium PM fed from the medium feeding roller 12 may be conveyed to the secondary transfer section via the pair of conveying rollers 22 after a skew of the medium PM is corrected by the pair of conveying rollers 22.

In this example, when a tip position of the medium PM is detected by the position sensor 24, a detection signal may be transmitted to the printing controller 700. The printing controller 700 may adjust the conveyance speed of the medium PM and the rotation speed of the intermediate transfer belt 41, and thereby align the medium PM with the transparent toner image or the white toner image on the intermediate transfer belt 41. This may cause the transparent toner image or the white toner image on the intermediate transfer belt 41 to be subjected to secondary transfer in a predetermined region of the medium PM, at a secondary transfer position, i.e., a position at which the backup roller 44 and the secondary transfer roller 45 face each other. Thereafter, the fixing section 105 may apply heat and pressure to the transparent toner image or the white toner image that has been transferred onto the medium PM, and thereby fix the transparent toner image or the white toner image to the medium PM. This may complete the image forming operation for the first time on the medium PM.

The medium PM to which the transparent toner image or the white toner image is fixed as a first layer may be once discharged, by components such as the pair of conveying rollers 62, from the fixing section 105 toward the downstream of the fixing section 105. When the position sensor 61 detects the discharging of the medium PM from the fixing section 105, the pairs of conveying rollers 21, 22, 62, and 71 may start to rotate reversely on the basis of an instruction given by the printing controller 700, thereby conveying the medium PM from the downstream toward the upstream. Such conveyance may be stopped when the medium PM passes through the position sensor 24, for example.

Thereafter, the image forming operation for the second time on the medium PM may be performed basically in a manner similar to that of the image forming operation for the first time. Upon the image forming operation for the second time, however, the colored image may be formed as a second layer on the transparent toner image or the white toner image that has been formed on the medium PM as the first layer. Specifically, the primary transfer section may sequentially transfer, onto the intermediate transfer belt 41, the yellow toner image, the magenta toner image, the cyan toner image, and the black toner image on the respective photosensitive drums 31, and thereby allow the yellow toner image, the magenta toner image, the cyan toner image, and the black toner image to be overlaid with each other. Thereafter, the secondary transfer section may so perform secondary transfer of the colored image. Specifically, the secondary transfer section may so transfer, as the second layer, the colored image formed on the surface of the intermediate transfer belt 41 that the transparent toner image or the white toner image formed on the medium PM as the first layer is overlaid with the colored image. Thereafter, the fixing section 105 may perform the fixing operation of the colored image formed as the second layer. This may complete the image forming operation for the second time, and the medium PM may be discharged onto the placement tray 100K provided outside the housing 100.

[B. Detailed Operation of Transfer Section 104]

A detailed description is given below of an operation of the transfer section 104, with reference to FIGS. 3A to 3D. FIGS. 3A to 3D schematically illustrate, in order, respective cross-sections of processes of forming an image on the medium PM. The transfer section 104 may transfer of the white image or the transparent image as the first layer onto the medium PM on the basis of a first transfer condition, and transfer of the colored layer as the second layer onto the medium PM on the basis of a second transfer condition that is different from the first transfer condition. In this example, the first transfer condition and the second transfer condition may be related to magnitude of "current density" in the medium PM, for example. In one example embodiment, first current density (the first transfer condition) at a time when the white toner image or the transparent toner image is transferred as the first layer may be higher than second current density (the second transfer condition) at a time when the colored image is transferred as the second layer. The foregoing "current density" may be adjustable by varying a transfer voltage V to be applied to the secondary transfer roller 45, for example. Specifically, the "current density" in the medium PM may be higher as the transfer voltage V is caused to be higher, and the "current density" in the medium PM may be lower as the transfer voltage V is caused to be lower.

Figure 3A:
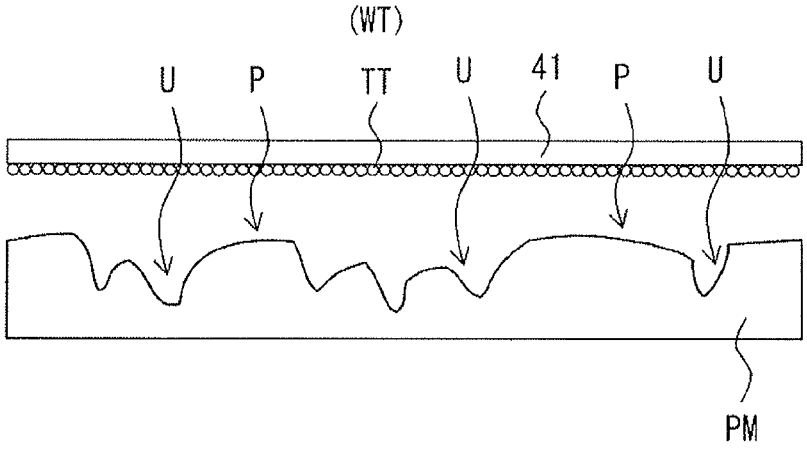
FIG. 3A is a schematic cross-sectional view of a process of image forming performed by a transfer section illustrated in FIG. 1.
Figure 3B:
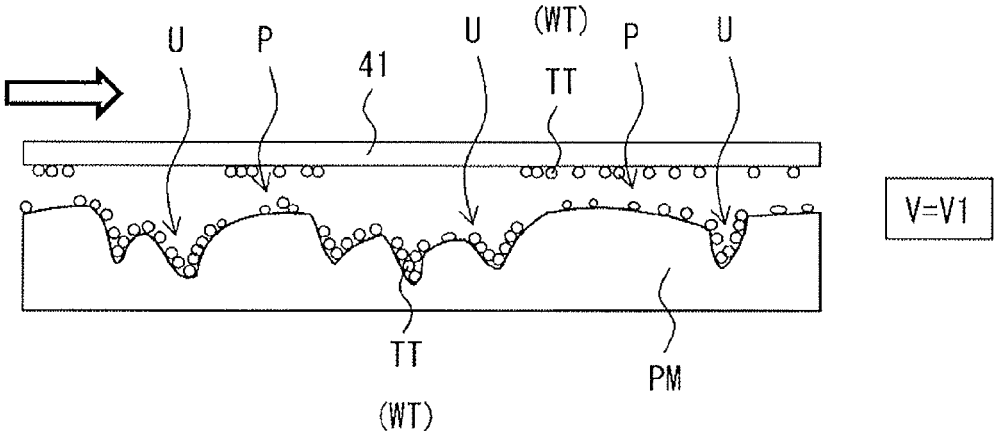
FIG. 3B is a schematic cross-sectional view of a process following the process illustrated in FIG. 3A.

A description is given below of an example case where a transparent toner image TT or a white toner image WT may be formed as the first layer, and a colored image including a yellow toner image YT, a magenta toner image MT, and a cyan toner image CT may be formed as the second layer. Upon transferring the transparent toner image TT or the white toner image WT onto the medium PM as the first layer, first, referring to FIG. 3A, primary transfer may be so performed as to transfer, onto the intermediate transfer belt 41, the transparent toner image TT or the white toner image WT that has been formed by the image forming unit 30T or 30W. It is to be noted that the surface of the intermediate transfer belt 41 may be relatively flat; however, the surface of the medium PM onto which the image is to be transferred may have depressions U and protrusions P that are provided side by side irregularly, for example. Thereafter, referring to FIG. 3B, the secondary transfer section may transfer the transparent toner image TT or the white toner image WT onto the medium PM. Upon the transfer of the transparent toner image TT or the white toner image WT onto the medium PM, the transfer voltage to be applied to the secondary transfer roller 45 may be a transfer voltage V1. It is to be noted that FIG. 3B illustrates a state that is immediately after a portion of the intermediate transfer belt 41 and a portion of the medium PM that face each other have been brought into contact sequentially from the left side to the right side of the paper plane of FIG. 3B, and the secondary transfer has been thereby performed. As illustrated in FIG. 3B, the depressions U may be filled with the transparent toner image TT or the white toner image WT at relatively-high density. In contrast, the amount of the transparent toner image TT or the white toner image WT transferred onto the protrusions P may be relatively small. Accordingly, part of the transparent toner image TT (the white toner image WT) may remain on the intermediate transfer belt 41. One possible reason for this is as follows. That is, the protrusions P may have contact stress with the intermediate transfer belt 41 that is greater than that of the depressions U. Therefore, a transfer current that is greater than a transfer current that passes through the depressions U may pass through the protrusions P in a thickness direction of the medium PM. This may decrease transfer efficiency at the protrusions P.

Figure 3C:
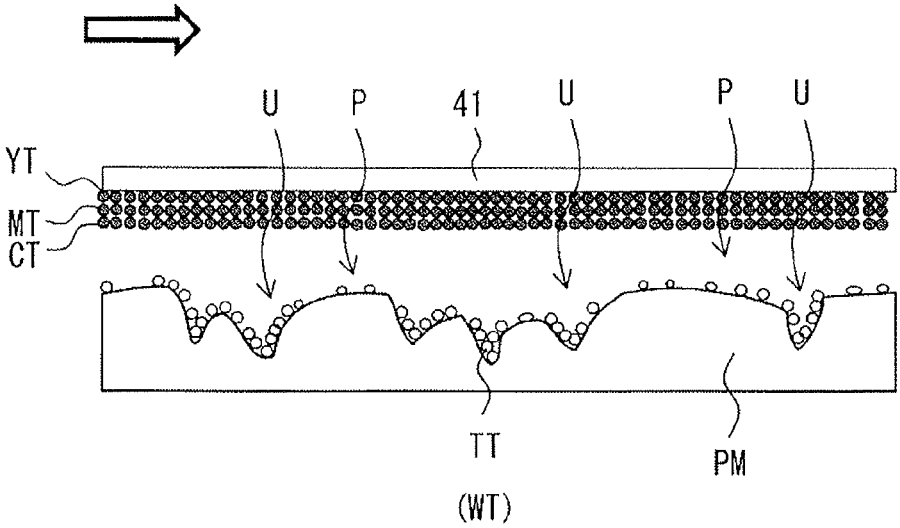
FIG. 3C is a schematic cross-sectional view of a process following the process illustrated in FIG. 3B.

After the operations of transferring the transparent toner image TT or the white toner image WT onto the medium PM as the first layer and fixing the transferred transparent toner image TT or the transferred white toner image WT to the medium PM are completed, the primary transfer may be so performed as to transfer, for example, the yellow toner image YT, the magenta toner image MT, and the cyan toner image CT in order onto the intermediate transfer belt 41, as illustrated in FIG. 3C. It is to be noted that the remains of the transparent toner image TT or the white toner image WT on the surface of the intermediate transfer belt 41 may be removed beforehand by a member such as a cleaning blade. In this example, on the surface of the medium PM, the depressions U may be so filled with the transparent toner image TT or the white toner image WT in a concentrated manner that the depressions U are full of the transparent toner image TT or the white toner image WT.

Figure 3D:
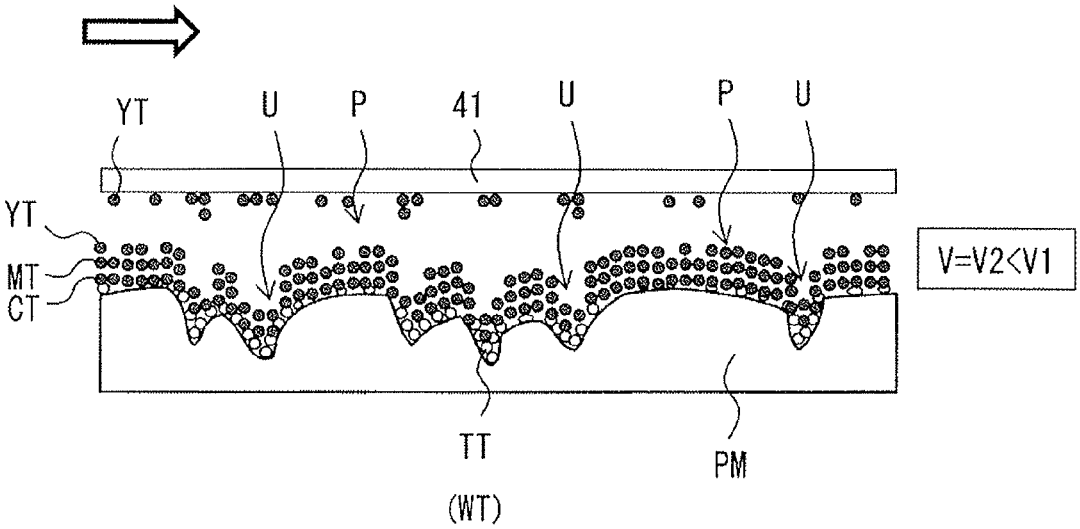
FIG. 3D is a schematic cross-sectional view of a process following the process illustrated in FIG. 3C.

Thereafter, referring to FIG. 3D, the secondary transfer section may so transfer the yellow toner image YT, the magenta toner image MT, and the cyan toner image CT that the transparent toner image IT or the white toner image WT on the medium PM is overlaid with the yellow toner image YT, the magenta toner image MT, and the cyan toner image CT. Upon this transfer, the transfer voltage to be applied to the secondary transfer roller 45 may be a transfer voltage V2 that is lower than V1 (V2<V1). It is to be noted that FIG. 3D illustrates, as with FIG. 3B, a state that is immediately after a portion of the intermediate transfer belt 41 and a portion of the medium PM that face each other have been brought into contact sequentially from the left side to the right side of the paper plane of FIG. 3D, and the secondary transfer has been performed. Referring to FIG. 3D, the yellow toner image YT, the magenta toner image MT, and the cyan toner image CT may be transferred evenly at the protrusions P and the depressions U. Part of the colored image, in particular, part of the yellow toner image YT, however, may remain on the intermediate transfer belt 41 without having been removed from the intermediate transfer belt 41.

[C. Example Effects]

According to the first example embodiment, the transparent image or the white image may be formed as the first layer, and thereafter, the colored image may be formed as the second layer, as described above. Accordingly, the secondary transfer may be so performed that the colored image is transferred onto the medium PM in accordance with the irregularities on the medium PM, even when the medium PM has a surface with great irregularities. This improves an amount at which the depressions U are filled with the colored image, reproducibility of fine lines, etc., thereby achieving improved image formation. In particular, the transparent image or the white image of the first layer may be so transferred that the transparent image or the white image may be selectively transferred onto the depressions U in a concentrated manner, by causing the transfer voltage V1 for the first layer to be higher than the transfer voltage V2 for the second layer. Accordingly, the colored image, as the second layer to be formed on the transparent image or the white image of the first layer, is transferred onto the depressions U with certainty. Hence, it is possible to achieve improved image formation.

2. Second Example Embodiment

[2-1. Outline]

A description is given below of an image forming apparatus according to a second example embodiment of the technology. The image forming apparatus according to the foregoing first example embodiment may form the transparent image or the white image on the medium PM and fix the formed transparent image or the formed white image, as the image forming operation for the first time. Further, the image forming apparatus according to the foregoing first example embodiment may transfer the colored image on the foregoing transparent image or the foregoing white image and fix the transferred colored image, as the image forming operation for the second time. In contrast, the image forming apparatus according to the second example embodiment may form the transparent image or the white image on the medium PM and fix the formed transparent image or the formed white image, as the image forming operation for the first time. Further, the image forming apparatus according to the second example embodiment may transfer together the colored image and the transparent image that are overlaid with each other, and fix together the colored image and the transparent image that are overlaid with each other, as the image forming operation for the second time.

[2-2. Detailed Operations of Image Forming Section 103 and Transfer Section 104]

A detailed description is given below of operations of the image forming section 103 and the transfer section 104 according to the second example embodiment, with reference to FIGS. 4A to 4D. FIGS. 4A to 4D schematically illustrate, in order, respective cross-sections of processes of forming an image on the medium PM. The image forming section 103 according to the second example embodiment may execute a first image forming operation and a second image forming operation. The first image forming operation may form a first transparent image or a white image. The second image forming operation may sequentially form a second transparent image and a colored image after the first image forming operation is performed. Further, the transfer section 104 according to the second example embodiment may execute a first transfer operation and a second transfer operation. The first transfer operation may transfer the first transparent image or the white image onto the medium PM before the second image forming operation is performed. The second transfer operation may so transfer the colored image and the second transparent image that the colored image and the second transparent image are stacked in order on the first transparent image or the white image that has been transferred onto the medium PM.

A description is given below of the following example case. That is, in the image forming operation for the first time, a transparent toner image TT1 as the first transparent image may be formed on the medium PM and the formed transparent toner image TT1 may be fixed. Further, in the image forming operation for the second time, the colored image including the cyan toner image CT, the magenta toner image MT, and the yellow toner image YT, and a transparent toner image TT2 as the second transparent image may be formed on the transparent toner image TT1 and the formed colored image and the formed second transparent image may be fixed.

Figure 4A:
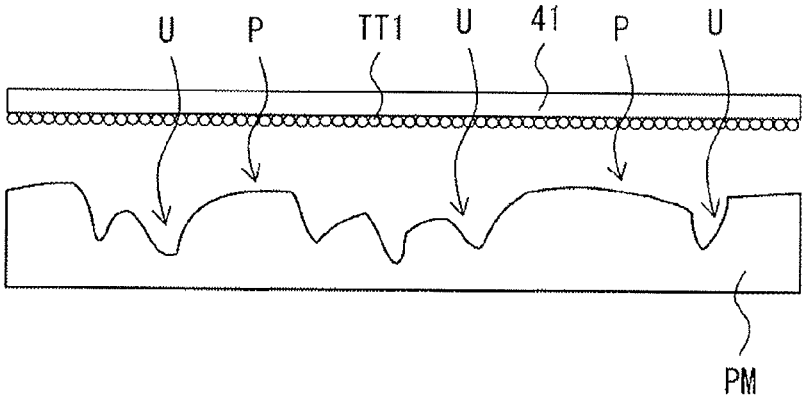
FIG. 4A is a schematic cross-sectional view of a process of image formation performed by a transfer section of an image forming apparatus according to a second example embodiment of the technology.
Figure 4B:
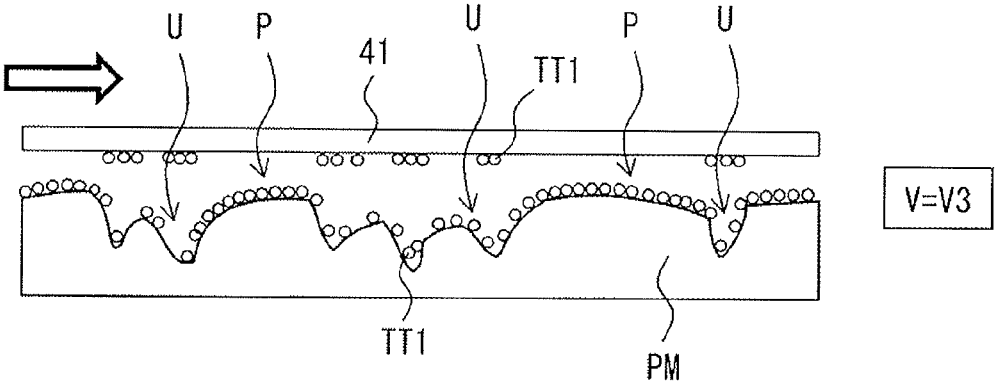
FIG. 4B is a schematic cross-sectional view of a process following the process illustrated in FIG. 4A.

Upon transferring the transparent toner image TT1 onto the medium PM, first, referring to FIG. 4A, primary transfer may be so performed as to transfer, onto the intermediate transfer belt 41, the transparent toner image TT1 that has been formed by the image forming unit 30T. It is to be noted that the surface of the intermediate transfer belt 41 may be relatively flat; however, the surface of the medium PM onto which the image is to be transferred may have depressions U and protrusions P that are provided side by side irregularly, for example. Thereafter, referring to FIG. 4B, the secondary transfer section may transfer the transparent toner image TT1 onto the medium PM. Upon the transfer of the transparent toner image TT1 onto the medium PM, the transfer voltage to be applied to the secondary transfer roller 45 may be a transfer voltage V3. The transfer voltage V3 may be equivalent to the transfer voltage V2 in the first example embodiment (V3=V2). It is to be noted that FIG. 4B illustrates a state that is immediately after a portion of the intermediate transfer belt 41 and a portion of the medium PM that face each other have been brought into contact sequentially from the left side to the right side of the paper plane of FIG. 4B, and the secondary transfer has been thereby performed. As illustrated in FIG. 4B, the depressions U may be filled with the transparent toner image TT1 at relatively-high density. Further, the transparent toner image TT1 may be also transferred onto the protrusions P at relatively-high density as with the depressions U. Accordingly, the transparent toner image TT1 may hardly remain on the intermediate transfer belt 41. One possible reason for this is as follows. That is, the transfer voltage V3 may be set to be lower than the transfer voltage V1 in the foregoing first example embodiment. This suppresses a transfer current that passes through the protrusions P. Accordingly, a decrease in transfer efficiency is also suppressed. As a result, the transparent toner image TT1 is formed on the medium PM with an even thickness, compared with the state illustrated in FIG. 3B of the foregoing first example embodiment.

Figure 4C:
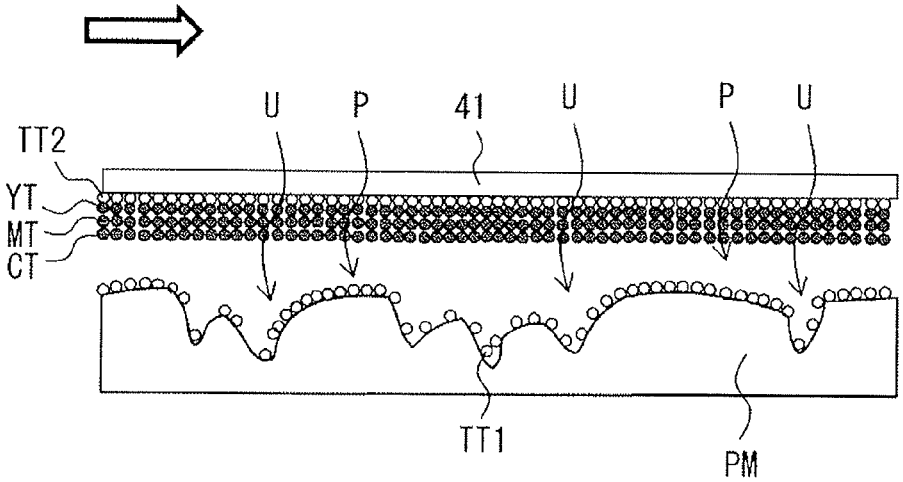
FIG. 4C is a schematic cross-sectional view of a process following the process illustrated in FIG. 4B.

After the operations of transferring the transparent toner image TT1 onto the medium PM and fixing the transferred transparent toner image TT1 are completed, the primary transfer may be so performed as to transfer, for example, the second transparent image (a transparent toner image TT2) and the colored image (the yellow toner image YT, the magenta toner image MT, and the cyan toner image CT) in order onto the intermediate transfer belt 41, as illustrated in FIG. 4C. It is to be noted that the remains of the transparent toner image TT1 on the surface of the intermediate transfer belt 41 may be removed beforehand by a member such as a cleaning blade.

Figure 4D:
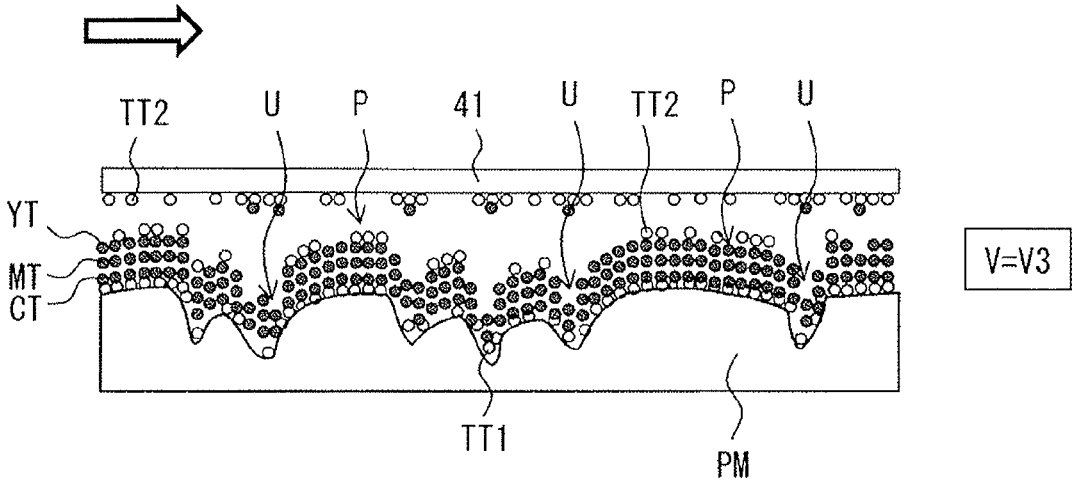
FIG. 4D is a schematic cross-sectional view of a process following the process illustrated in FIG. 4C.

Thereafter, referring to FIG. 4D, the secondary transfer section may so transfer the cyan toner image CT, the magenta toner image MT, the yellow toner image YT, and the transparent toner image TT2 that the transparent toner image TT1 on the medium PM is overlaid with the cyan toner image CT, the magenta toner image MT, the yellow toner image YT, and the transparent toner image TT2. Upon this transfer, the transfer voltage to be applied to the secondary transfer roller 45 may be the transfer voltage V3. It is to be noted that FIG. 4D illustrates, as with FIG. 4B, a state that is immediately after a portion of the intermediate transfer belt 41 and a portion of the medium PM that face each other have been brought into contact sequentially from the left side to the right side of the paper plane of FIG. 4D, and the secondary transfer has been performed. Referring to FIG. 4D, the cyan toner image CT, the magenta toner image MT, and the yellow toner image YT may be transferred evenly at the protrusions P and the depressions U. It is to be noted that much of the transparent toner image TT2 may remain on the intermediate transfer belt 41 without having been removed from the intermediate transfer belt 41. The transparent toner image TT2 may thus serve as a sacrifice layer in the secondary transfer section. This prevents part of the colored image, in particular, the yellow toner image YT, from remaining on the intermediate transfer belt 41. It is to be noted that FIGS. 4A to 4D refer to the example case where the transparent toner image TT1 as the first transparent image may be formed on the medium PM and the formed transparent toner image TT1 may be fixed in the image forming operation for the first time; however, the technology is not limited thereto. Alternatively, for example, the white image may be formed on the medium PM and the formed white image may be fixed, in the image forming operation for the first time. Further, in accordance with the color of the medium PM, a toner image of each of the colors including yellow, cyan, magenta, and black may be formed and the formed toner image may be fixed. Alternatively, a toner image of a mixed color derived from mixing of a plurality of colors of the foregoing colors may be formed and the formed toner image may be fixed.

[2-3. Example Effects]

Also according to the second example embodiment, the first transparent image or the white image may be formed as the first layer, and thereafter, the colored image may be formed as the second layer, as described above. Accordingly, the secondary transfer may be so performed that the colored image is transferred onto the medium PM in accordance with the irregularities on the medium PM, even when the medium PM has a surface with great irregularities. This improves an amount at which the depressions U are filled with the colored image, reproducibility of fine lines, etc., thereby achieving improved image formation. According to the second example embodiment, the second transparent image may be further formed between the colored image and the intermediate transfer belt 41. This allows, upon the secondary transfer, most of the colored image to be moved onto the medium PM without remaining on the intermediate transfer belt 41. Accordingly, desired printing density is secured. Hence, it is possible to achieve further improved image formation.

3. Third Example Embodiment

[3-1. Outline]

A description is given below of an image forming apparatus according to a third example embodiment of the technology. In the image forming apparatus according to the foregoing second example embodiment, the transfer voltage used in the image forming operation for the first time may be equivalent to the transfer voltage used in the image forming operation for the second time. In contrast, in the image forming apparatus according to the third example embodiment, the transfer voltage used in the image forming operation for the first time may be higher than the transfer voltage used in the image forming operation for the second time. The third example embodiment may be similar to the foregoing second example embodiment in other points excluding the point described above.

[3-2. Detailed Operations of Image Forming Section 103 and Transfer Section 104]

A detailed description is given below of operations of the image forming section 103 and the transfer section 104 according to the third example embodiment, with reference to FIGS. 5A to 5D. FIGS. 5A to 5D schematically illustrate, in order, respective cross-sections of processes of forming an image on the medium PM. The image forming section 103 according to the third example embodiment may execute the first image forming operation and the second image forming operation. The first image forming operation may form the first transparent image or the white image. The second image forming operation may sequentially form the second transparent image and the colored image after the first image forming operation is executed. Further, the transfer section 104 according to the third example embodiment may execute the first transfer operation and execute the second transfer operation. The first transfer operation may transfer the first transparent image or the white image onto the medium PM before the second image forming operation is executed. The second transfer operation may so transfer the colored image and the second transparent image that the colored image and the second transparent image are stacked in order on the first transparent image or the white image that has been transferred onto the medium PM.

A description is given below of the following example case. That is, in the image forming operation for the first time, the transparent toner image TT1 as the first transparent image may be formed on the medium PM and the formed transparent toner image TT1 may be fixed. Further, in the image forming operation for the second time, the colored image including the cyan toner image CT, the magenta toner image MT, and the yellow toner image YT, and the transparent toner image TT2 as the second transparent image may be formed on the transparent toner image TT1, and the formed colored image and the formed second transparent image may be fixed.

Figure 5A:
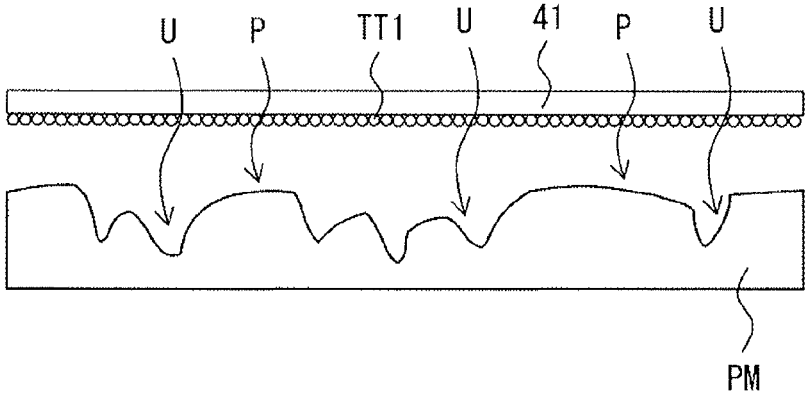
FIG. 5A is a schematic cross-sectional view of a process of image formation performed by a transfer section of an image forming apparatus according to a third example embodiment of the technology.
Figure 5B:
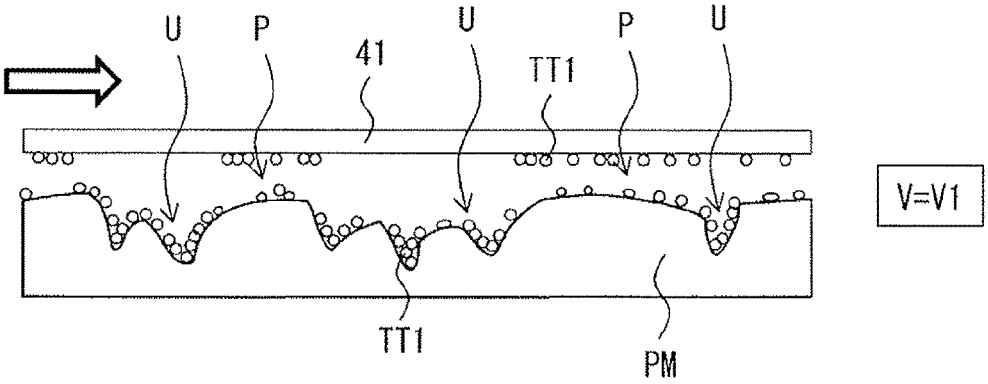
FIG. 5B is a schematic cross-sectional view of a process following the process illustrated in FIG. 5A.

Upon transferring the transparent toner image TT1 onto the medium PM, first, referring to FIG. 5A, primary transfer may be so performed as to transfer, onto the intermediate transfer belt 41, the transparent toner image TT1 that has been formed by the image forming unit 30T. Thereafter, referring to FIG. 5B, the secondary transfer section may transfer the transparent toner image TT1 onto the medium PM. Upon the transfer of the transparent toner image TT1 onto the medium PM, the transfer voltage to be applied to the secondary transfer roller 45 may be the transfer voltage V1. The transfer voltage V1 may be substantially the same as the transfer voltage V1 in the first example embodiment. It is to be noted that FIG. 5B illustrates a state that is immediately after a portion of the intermediate transfer belt 41 and a portion of the medium PM that face each other have been brought into contact sequentially from the left side to the right side of the paper plane of FIG. 5B, and the secondary transfer has been thereby performed. As illustrated in FIG. 5B, the depressions U may be filled with the transparent toner image TT1 at relatively-high density. In contrast, the amount of the transparent toner image TT1 transferred onto the protrusions P may be relatively small. Accordingly, part of the transparent toner image TT1 may remain on the intermediate transfer belt 41.

Figure 5C:
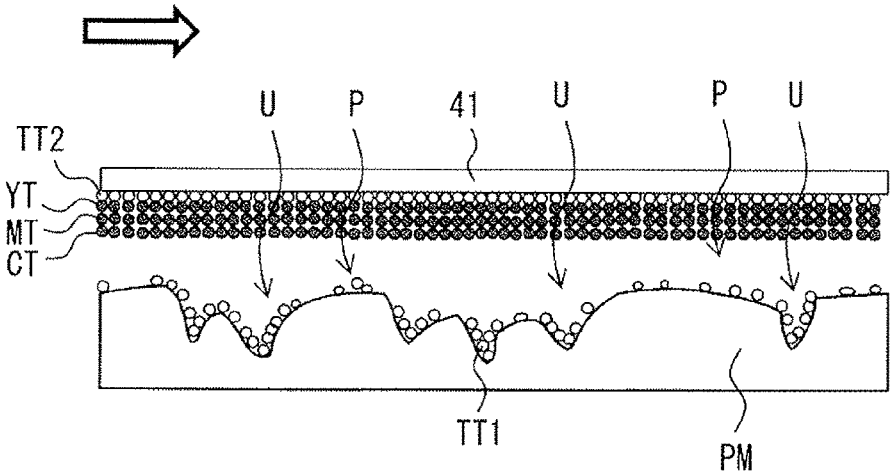
FIG. 5C is a schematic cross-sectional view of a process following the process illustrated in FIG. 5B.

After the operations of transferring the transparent toner image TT1 onto the medium PM and fixing the transferred transparent toner image TT are completed, the primary transfer may be so performed as to transfer, for example, the second transparent image (the transparent toner image TT2) and the colored image (the yellow toner image YT, the magenta toner image MT, and the cyan toner image CT) in order onto the intermediate transfer belt 41, as illustrated in FIG. 5C. It is to be noted that the remains of the transparent toner image TT1 on the surface of the intermediate transfer belt 41 may be removed beforehand by a member such as a cleaning blade. In this example, on the surface of the medium PM, the depressions U may be so filled with the transparent toner image TT1 selectively that the depressions U are full of the transparent toner image TT1. This moderates variations in height of the surface onto which the colored image as the second layer is to be transferred.

Figure 5D:
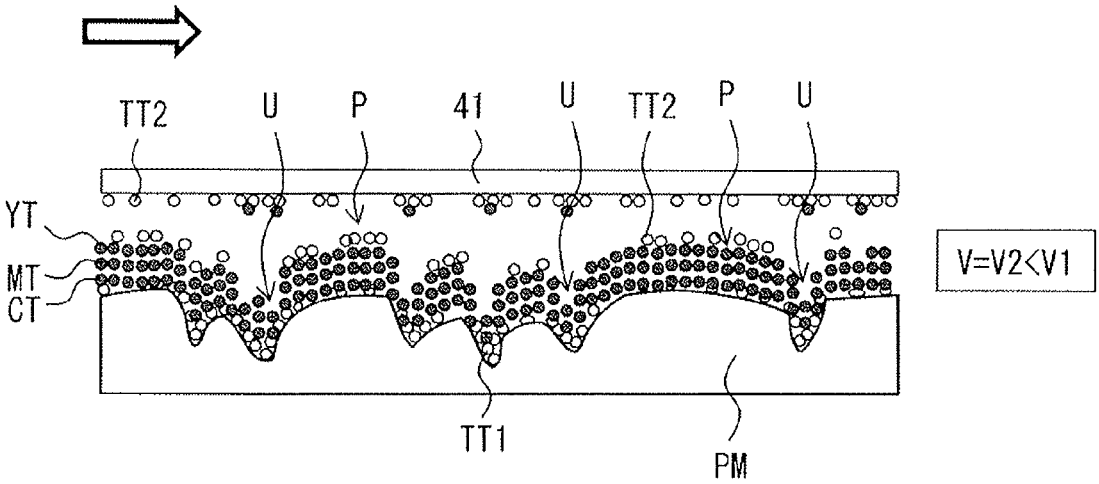
FIG. 5D is a schematic cross-sectional view of a process following the process illustrated in FIG. 5C.

Thereafter, referring to FIG. 5D, the secondary transfer section may so transfer the cyan toner image CT, the magenta toner image MT, the yellow toner image YT, and the transparent toner image TT2 that the transparent toner image TT1 on the medium PM is overlaid with the cyan toner image CT, the magenta toner image MT, the yellow toner image YT, and the transparent toner image TT2. Upon this transfer, the transfer voltage to be applied to the secondary transfer roller 45 may be the transfer voltage V2. The transfer voltage V2 may be substantially the same as the transfer voltage V2 in the foregoing first example embodiment. It is to be noted that FIG. 5D illustrates, as with FIG. 5B, a state that is immediately after a portion of the intermediate transfer belt 41 and a portion of the medium PM that face each other have been brought into contact sequentially from the left side to the right side of the paper plane of FIG. 5D, and the secondary transfer has been performed. Referring to FIG. 5D, the cyan toner image CT, the magenta toner image MT, and the yellow toner image YT may be transferred evenly at the protrusions P and the depressions U. It is to be noted that much of the transparent toner image TT2 may remain on the intermediate transfer belt 41 without having been removed from the intermediate transfer belt 41. The transparent toner image TT2 may thus serve as a sacrifice layer in the secondary transfer section. This prevents part of the colored image, in particular, the yellow toner image YT, from remaining on the intermediate transfer belt 41. It is to be noted that FIGS. 5A to 5D refer to the example case where the transparent toner image TT1 as the first transparent image may be formed on the medium PM and the formed transparent toner image TT1 may be fixed, in the image forming operation for the first time; however, the technology is not limited thereto. Alternatively, for example, the white image may be formed on the medium PM and the formed white image may be fixed, in the image forming operation for the first time.

[3-3. Example Effects]

Also according to the third example embodiment, the first transparent image or the white image may be formed as the first layer, and thereafter, the colored image may be formed as the second layer, as described above. Accordingly, the secondary transfer may be so performed that the colored image is transferred onto the medium PM in accordance with the irregularities on the medium PM, even when the medium PM has a surface with great irregularities. In particular, the first transparent image or the white image of the first layer may be so transferred that the first transparent image or the white image is selectively transferred onto the depressions U in a concentrated manner, by causing the transfer voltage V1 for the first layer to be higher than the transfer voltage V2 for the second layer. Accordingly, it is possible to ensure that the colored image of the second layer formed on the transparent image or the white image of the first layer be transferred onto the depressions U. This improves an amount at which the depressions U are filled with the colored image, reproducibility of fine lines, etc., thereby achieving improved image formation. According to the third example embodiment, the second transparent image may be further formed between the colored image and the intermediate transfer belt 41. This allows, upon the second transfer, most of the colored image to be moved onto the medium PM without remaining on the intermediate transfer belt 41. Accordingly, desired printing density is secured. Hence, it is possible to achieve further improved image formation.

4. Experimental Examples

Experimental Example 1-1

An image including the first transparent image, the colored image, and the second transparent image in order was printed on the medium PM, by the procedures described above in the third example embodiment. As the medium PM, Lethac 66 as embossed paper available from Tokushu Tokai Paper Co., Ltd., Shizuoka, Japan was used. The experiment was performed under an environment having a temperature of 23 degrees centigrade and humidity of 50%. In this experiment, first, the following was performed as the image forming operation for the first time. That is, the primary transfer was so performed as to transfer the first transparent image at a duty ratio of 100% onto the entire surface of the intermediate transfer belt 41 by the use of the transparent toner (C941 available from Oki Data Corporation, Tokyo, Japan). Thereafter, the secondary transfer was so performed as to transfer the first transparent image onto the medium PM and the transferred first transparent image was fixed. Thereafter, the following was performed as the image forming operation for the second time. That is, the primary transfer was so performed as to transfer the second transparent image at the duty ratio of 100% by the use of the transparent toner onto the entire surface of the intermediate transfer belt 41. The primary transfer was also so performed as to transfer, as the colored image, a fine line pattern at a duty ratio of 40% by the use of the cyan toner, onto the second transparent image. Thereafter, the secondary transfer was performed. Specifically, the second transparent image and the colored image were so transferred that the first transparent image on the medium PM was overlaid with the second transparent image and the colored image, and the transferred second transparent image and the transferred colored image were fixed. The fine line pattern herein refers to a pattern in which a plurality of fine lines each having a width of 60 μm are formed adjacent to each other at intervals of 80 μm. Further, the transfer voltage V1 at a time when the secondary transfer of the first transparent image was performed was set to 2000 V, and the transfer voltage V2 at a time when the secondary transfer of the second transparent image and the colored image was performed was set to 1800 V. For the image on the medium PM thus obtained, a colored toner filling amount by which the depressions U were filled with the colored toner was evaluated, and reproducibility of the fine lines was also evaluated. Table 1 describes results of the evaluations.

TABLE 1

| | Formed image configuration | | Secondary transfer voltage [kV] | | Image evaluation | |
|---|---|---|---|---|---|---|
| | First time | Second time | V1 | V2 | Filling amount | Reproducibility of fine lines |
| Experimental example 1-1 | First transparent image | Colored image/ Second transparent image | 2.0 | 1.8 | A | S |
| Experimental example 1-2 | First transparent image | Colored image/ Second transparent image | 2.5 | 1.8 | S | S |
| Experimental example 1-3 | First transparent image | Colored image/ Second transparent image | 3.0 | 1.8 | S | S |
| Experimental example 1-4 | First transparent image | Colored image/ Second transparent image | 4.0 | 1.8 | S | S |
| Experimental example 1-5 | First transparent image | Colored image/ Second transparent image | 1.8 | 1.8 | B | B |
| Experimental example 1-6 | First transparent image | Colored image/ Second transparent image | 1.0 | 1.8 | B | B |

It is to be noted that the colored toner filling amount herein is defined as a ratio of a weight per unit area of the colored toner that configures the colored image attached to the depressions on the medium PM, relative to a weight per unit area of the colored toner that configures the colored image attached to the protrusions on the medium PM. The colored toner filling amount that was equal to or higher than 80% was evaluated as "excellent" and described as "S". The colored toner filling amount that was equal to or higher than 65% and lower than 80% was evaluated as "good" and described as "A". The colored toner filling amount that was equal to or higher than 50% and lower than 65% was evaluated as "fair" and described as "B". The colored toner filling amount that was lower than 50% was evaluated as "poor" and described as "F". Further, the reproducibility of the fine lines herein refers to distinguishability, from each other, of the fine line patterns that are adjacent to each other and printed on the protrusions P and the depressions U on the medium PM. Specifically, a case where the fine line pattern was printed clearly at both of the protrusions P and the depressions U, and visual distinction between the fine lines was sufficiently possible, was evaluated as "excellent" and described as "S". A case where a difference was visually recognized between the fine line pattern printed on the protrusions P and the fine line pattern printed on the depressions U, however, the visual distinction between the fine lines was possible without any problem, was evaluated as "good" and described as "A". A case where an edge of the fine line pattern printed on the depressions U was slightly blurred compared to the fine line pattern printed on the protrusions P, however, the visual distinction between the fine lines was possible, was evaluated as "fair" and described as "B". A case where the distinction between the adjacent fine lines was difficult at the depressions U, was evaluated as "poor" and described as "F". It is to be noted that the image forming apparatus that was evaluated as "S" or "A" for both of the colored toner filling amount and the reproducibility of the fine lines sufficiently had the level that was sufficiently usable as a product.

Experimental Examples 1-2 to 1-6

In each of Experimental examples 1-2 to 1-6, an image was printed on the medium PM and evaluation was performed in a manner similar to that in Experimental example 1-1, except that the transfer voltage V1 used upon the primary transfer of the first transparent image was different from that in Experimental example 1-1. Specifically, the transfer voltage V1 was set to 2.5 kV in Experimental example 1-2, 3.0 kV in Experimental example 1-3, 4.0 kV in Experimental example 1-4, 1.8 kV in Experimental example 1-5, and 1.0 kV in Experimental example 1-6. Table 1 also describes results of the evaluations in Experimental examples 1-2 to 1-6 together with the result in Experimental example 1-1.

Experimental Examples 2-1 to 2-6

An image including the first transparent image and the colored image in order was printed on the medium PM by the procedures described above in the first example embodiment. Specifically, only transfer and fixing of the colored image were performed without performing transfer and fixing of the second transparent image, as the image forming operation for the second time. In each of Experimental examples 2-1 to 2-6, the image was printed on the medium PM and evaluation was performed in a manner similar to that of corresponding one of Experimental examples 1-1 to 1-6 for other points excluding the foregoing point. Table 2 describes results of the evaluations in Experimental examples 2-1 to 2-6.

TABLE 2

| | Formed image configuration | | Secondary transfer voltage [kV] | | Image evaluation | |
|---|---|---|---|---|---|---|
| | First time | Second time | V1 | V2 | Filling amount | Reproducibility of fine lines |
| Experimental example 2-1 | First transparent image | Colored image | 2.0 | 1.8 | A | A |
| Experimental example 2-2 | First transparent image | Colored image | 2.5 | 1.8 | A | A |
| Experimental example 2-3 | First transparent image | Colored image | 3.0 | 1.8 | A | A |

TABLE 2-continued

| | Formed image configuration | | Secondary transfer voltage [kV] | | Image evaluation | |
|---|---|---|---|---|---|---|
| | First time | Second time | V1 | V2 | Filling amount | Reproducibility of fine lines |
| Experimental example 2-4 | First transparent image | Colored image | 4.0 | 1.8 | A | A |
| Experimental example 2-5 | First transparent image | Colored image | 1.8 | 1.8 | B | B |
| Experimental example 2-6 | First transparent image | Colored image | 1.0 | 1.8 | B | B |

Experimental Example 3-1

The colored image was transferred onto the medium PM and the transferred colored image was fixed, without performing the image forming operation for the first time (formation of the first transparent image). In Experimental example 3-1, the image was printed on the medium PM and evaluation was performed in a manner similar to that in Experimental example 2-1 for other points excluding the foregoing point. Table 3 describes a result of the evaluation in Experimental example 3-1.

TABLE 3

| | Formed image configuration | | Secondary transfer voltage [kV] | | Image evaluation | |
|---|---|---|---|---|---|---|
| | First time | Second time | V1 | V2 | Filling amount | Reproducibility of fine lines |
| Experimental example 3-1 | — | Colored image | — | 1.8 | F | F |
| Experimental example 3-2 | — | Colored image/ Transparent image | — | 1.8 | A | F |

Experimental Example 3-2

The colored image and the transparent image were transferred onto the medium PM and the transferred colored image and the transferred transparent image were fixed, without performing the image forming operation for the first time (formation of the first transparent image). In Experimental example 3-2, the image was printed on the medium PM and evaluation was performed in a manner similar to that in Experimental example 1-1 or other points excluding the foregoing point. Table 3 also describes a result of the evaluation in Experimental example 3-2, together with the result in Experimental example 3-1.

Referring to Table 1, in each of Experimental examples 1-1 to 1-4, both of the colored toner filling amount and the reproducibility of the fine lines were evaluated as "excellent" or "good". One possible reason is as follows. That is, the depressions U were selectively filled with the first transparent image by forming the first transparent image on the medium PM before forming the colored image. This improved flatness of the surface onto which the colored image was to be transferred. Another possible reason is that an influence of electric discharge due to a void inside the medium PM was able to be avoided or moderated by forming the first transparent image on the medium PM before forming the colored image. Still another possible reason is that fixing efficiency of the colored image was improved by causing the first transparent image formed on the medium PM before forming the colored image to have a temperature that was higher than that of the medium PM. Further, in Experimental examples 1-5 and 1-6, both of the colored toner filling amount and the reproducibility of the fine lines were evaluated slightly lower than those in Example embodiments 1-1 to 1-4. One possible reason for this is as follows. That is, the secondary transfer voltage V1 for the first time was similar to or lower than the secondary transfer voltage V2 for the second time. This caused the first transparent image to be attached thickly not only to the depressions U but also to the protrusions P. This slightly increased the roughness (undulations) of the surface onto which the colored image was to be transferred.

Referring to Table 2, in each of Experimental examples 2-1 to 2-6, both of the colored toner filling amount and the reproducibility of the fine lines were evaluated slightly lower than those in Experimental examples 1-1 to 1-6. One possible reason is as follows. That is, the second transparent image was not formed on the intermediate transfer belt 41 upon the image forming operation for the second time. Therefore, part of the colored toner configuring the colored image remained on the intermediate transfer belt 41 when the secondary transfer of the colored image was performed. This might possibly influenced the colored toner filling amount and the reproducibility of the fine lines.

In contrast, in each of Experimental examples 3-1 and 3-2, the reproducibility of the fine lines, in particular, was evaluated poorly. One possible reason is as follows. That is, the colored image was directly transferred onto the medium PM without forming the transparent image on the medium PM. Therefore, electric discharge due to the void inside the medium PM greatly influenced the reproducibility of the fine lines. Specifically, it is possible that the colored toner forming the colored image on the intermediate transfer belt 41 was scattered onto the medium PM before the secondary transfer was performed, which caused an outline of the fine lines to be blurred. Further, in each of Experimental examples 3-1 and 3-2, the first transparent image was not formed upon the image forming operation for the first time. It is possible that this decreased fixing efficiency of the colored image as well.

5. Other Modification Examples

The technology has been described above referring to the example embodiments. However, the technology is not limited to the example embodiments described above, and is modifiable in various ways. For example, the foregoing example embodiments are described referring to an example in which the first transfer condition and the second transfer condition of the transfer section are each related to the transfer voltage; however, the technology is not limited thereto. Alternatively, for example, the first transfer condition may be a first conveyance speed at which the medium passes through the transfer section upon the image forming operation for the first time, and the second transfer condition may be a second conveyance speed at which the medium passes through the transfer section upon the image forming operation for the second time. In this example case, the first conveyance speed may be lower than the second conveyance speed in one example embodiment. By causing the first conveyance speed to be relatively low, time that is necessary for the medium to pass through the nip part at a time of the image forming operation for the first time may become longer than time that is necessary for the medium to pass through the nip part at a time of the image forming operation for the second time. In other words, time during which the transfer current is applied to the medium may become longer. The transfer current may greatly influence, in particular, the protrusions having a great nip pressure on the medium. As a result, the transparent image or the white image of the first layer may be selectively transferred onto the depressions in a concentrated manner.

Alternatively, the first transfer condition may be a first transfer pressure that is to be applied to the medium when the transfer section transfers the first developer image, and the second transfer condition may be a second transfer pressure that is to be applied to the medium when the transfer section transfers the second developer image. In this case, the first transfer pressure may be greater than the second transfer pressure in one example embodiment. One reason for this is as follows. That is, the nip pressure may be higher at the protrusions than at the depressions. As a result, the transparent image or the white image of the first layer may be selectively transferred onto the depressions in a concentrated manner. Further, it may be easy for particles of the toner applied with a relatively high pressure at the protrusions to be plastically deformed. Force may be increased by which the particles of the toner plastically deformed at the protrusions is attached to the transfer belt. Therefore, it may be easier for the toner particles to remain on the transfer belt, and it may be more difficult for the toner particles to be transferred onto the medium. Further, the force by which the particles of the toner plastically deformed at the protrusions are attached to the transfer belt may be greater than Coulomb force to be applied to the toner particles by a transfer electric field. This may also make it difficult for the toner particles to be transferred onto the medium from the transfer belt. In contrast, a pressure to be applied to the toner particles at the depressions may tend to be relatively lower than a pressure to be applied to the toner particles at the protrusions. Accordingly, it may be difficult for the toner particles to be plastically deformed at the depressions. Specifically, the force by which the toner particles are attached to the transfer belt has been once increased by the application of the pressure but may be decreased by release of the pressure, and return to a level before the application of the pressure. Therefore, it may be easy for the toner particles, on the transfer belt, at positions facing the depressions to be transferred onto the depressions from the transfer belt by the transfer electric field.

Moreover, a first fixing pressure (a nip pressure) may be applied to the medium when the fixing section fixes the first developer image, as a first fixing condition, instead of the first transfer condition, and a second fixing pressure (a nip pressure) may be applied to the medium when the fixing section fixes the second developer image, as a second fixing condition, instead of the second transfer condition. In this case, the first fixing pressure may be higher than the second fixing pressure in one example embodiment.

Moreover, the series of processes that have been described above in the foregoing example embodiments and the foregoing modification examples thereof may be performed by means of hardware (a circuit), or may be performed by means of software (a program). In the case where the series of processes are performed by means of the software, the software may include a group of programs directed to executing each function by a computer. Each of the programs may be provided to the foregoing computer beforehand, or may be installed on the foregoing computer from a network, a recording medium, etc., for example.

The foregoing example embodiments and the modification examples thereof have been described referring to the image forming apparatus having a printing function as an example corresponding to the "image forming apparatus" according to one specific but non-limiting embodiment of the technology. However, the function of the image forming apparatus is not limited thereto. Specifically, for example, the technology is also applicable to an image forming apparatus that serves as a multi-function peripheral having functions such as a scanner function and a facsimile function in addition to the printing function, for example.

Furthermore, the technology encompasses any possible combination of some or all of the various embodiments and the modifications described herein and incorporated herein.

It is possible to achieve at least the following configurations from the above-described example embodiments of the technology.

(1) An image forming apparatus including:

an image forming section including a first image forming unit that forms a first developer image and a second image forming unit that forms a second developer image; and a transfer section that transfers, on the basis of a first transfer condition, the first developer image onto a medium, and transfers, on the basis of a second transfer condition, the second developer image onto the medium onto which the first developer image has been transferred, the second transfer condition being different from the first transfer condition.

(2) The image forming apparatus according to (1), in which the first transfer condition includes a first current density used upon the transfer of the first developer image onto the medium, and the second transfer condition includes a second current density used upon the transfer of the second developer image onto the medium.

(3)

The image forming apparatus according to (2), in which the first developer image includes a transparent image, the second developer image includes a colored image, and the first current density is higher than the second current density.

(4)

The image forming apparatus according to (1), in which the first transfer condition includes a first transfer voltage used upon the transfer of the first developer image onto the medium, and the second transfer condition includes a second transfer voltage used upon the transfer of the second developer image onto the medium.

(5)

The image forming apparatus according to (4), in which the first developer image includes a transparent image, the second developer image includes a colored image, and the first transfer voltage is higher than the second transfer voltage.

(6)

The image forming apparatus according to (1), in which the first transfer condition includes a first conveyance speed at which the medium is to pass through the transfer section, and the second transfer condition includes a second conveyance speed at which the medium is to pass through the transfer section.

(7)

The image forming apparatus according to (6), in which the first developer image includes a transparent image, the second developer image includes a colored image, and the first conveyance speed is lower than the second conveyance speed.

(8)

The image forming apparatus according to (1), in which the first transfer condition includes a first pressure that is to be applied to the medium when the transfer section transfers the first developer image, and the second transfer condition includes a second pressure that is to be applied to the medium when the transfer section transfers the second developer image.

(9)

The image forming apparatus according to (8), in which the first developer image includes a transparent image, the second developer image includes a colored image, and the first pressure is higher than the second pressure.

(10)

The image forming apparatus according to any one of (1) to (9), further including a fixing section that fixes the first developer image to the medium after the transfer section has transferred the first developer image onto the medium and before the transfer section transfers the second developer image onto the medium, and fixes the second developer image to the medium after the transfer section has transferred the second developer image onto the medium.

(11)

An image forming apparatus including:

an image forming section including a first image forming unit that forms a first developer image and a second image forming unit that forms a second developer image;

a transfer section that transfers the first developer image onto a medium and transfers the second developer image onto the medium onto which the first developer image has been transferred; and a fixing section that fixes, on the basis of a first fixing condition, the first developer image to the medium after the transfer section has transferred the first developer image onto the medium and before the transfer section transfers the second developer image onto the medium, and fixes, on the basis of a second fixing condition, the second developer image to the medium after the transfer section has transferred the second developer image onto the medium, the second fixing condition being different from the first fixing condition.

(12)

The image forming apparatus according to (11), in which the first fixing condition includes a first pressure that is to be applied to the medium when the fixing section fixes the first developer image to the medium, and the second fixing condition includes a second pressure that is to be applied to the medium when the fixing section fixes the second developer image to the medium.

(13)

The image forming apparatus according to (12), in which the first developer image includes a transparent image, the second developer image includes a colored image, and the first pressure is higher than the second pressure.

(14)

An image forming apparatus including:

an image forming section that performs a first image forming operation and a second image forming operation, the first image forming operation forming a first developer image, the second image forming operation sequentially forming a second developer image and a third developer image after the first image forming operation has been performed, the first developer image being a first transparent image or a white image, the second developer image being a second transparent image, the third developer image being a colored image; and a transfer section that performs a first transfer operation and a second transfer operation, the first transfer operation transferring the first developer image onto a medium before the image forming section performs the second image forming operation, the second transfer operation transferring the third developer image and the second developer image onto the first developer image having been transferred onto the medium to allow the third developer image and the second developer image to be stacked in order on the first developer image having been transferred onto the medium.

(15)

The image forming apparatus according to (14), in which the transfer section includes a primary transfer section that performs first primary transfer and second primary transfer, the first primary transfer transferring the first developer image onto an intermediate transfer member, the second primary transfer transferring the second developer image and the third developer image onto the intermediate transfer member, and a secondary transfer section that performs first secondary transfer and second secondary transfer, the first secondary transfer transferring, onto the medium, the first developer image that has been transferred onto the intermediate transfer member, the second secondary transfer transferring, onto the first developer image that has been transferred onto the medium, the second developer image and the third developer image that have been transferred onto the intermediate transfer member.

In the image forming apparatus according to one embodiment of the technology, the transfer section transfers the first developer image onto the medium on the basis of the first transfer condition, and transfers the second developer image onto the medium onto which the first developer image has been transferred, on the basis of the second transfer condition that is different from the first transfer condition. Hence, appropriate transfer is performed on a medium having a surface with great irregularities.

In the image forming apparatus according to another embodiment of the technology, the fixing section fixes the first developer image on the basis of the first fixing condition, and fixes the second developer image on the basis of the second fixing condition that is different from the first fixing condition. Hence, appropriate transfer is performed on a medium having a surface with great irregularities.

According to the image forming apparatus of one embodiment of the technology, it is possible to form an image with improved quality on a medium having a surface with great irregularities.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising:

an image forming section that performs a first image forming operation and a second image forming operation, the first image forming operation forming a first developer image, the second image forming operation sequentially forming a second developer image and a third developer image after the first image forming operation has been performed, the first developer image being a first transparent image or a white image, the second developer image being a colored image, the third developer image being a second transparent image; and a transfer section that performs a first transfer operation at a first transfer voltage and a second transfer operation at a second transfer voltage, the first transfer operation transferring the first developer image onto a medium before the image forming section performs the second image forming operation, the second transfer operation transferring the second developer image and the third developer image onto the first developer image having been transferred onto the medium to allow the second developer image and the third developer image to be stacked in this order on the first developer image having been transferred onto the medium, an absolute value of the first transfer voltage is higher than an absolute value of the second transfer voltage.

2. The image forming apparatus according to claim 1, wherein the transfer section includes a primary transfer section that performs first primary transfer and second primary transfer, the first primary transfer transferring the first developer image onto an intermediate transfer member, the second primary transfer transferring the second developer image and the third developer image onto the intermediate transfer member, and a secondary transfer section that performs first secondary transfer and second secondary transfer, the first secondary transfer transferring, onto the medium, the first developer image that has been transferred onto the intermediate transfer member, the second secondary transfer transferring, onto the first developer image that has been transferred onto the medium, the second developer image and the third developer image that have been transferred onto the intermediate transfer member.

3. The image forming apparatus according to claim 1, wherein the transfer section performs the first transfer operation at first current density and performs the second transfer operation at second current density, and the first current density is greater than the second current density.

4. The image forming apparatus according to claim 1, wherein the medium has a surface including a protrusion and a depression, and transfer efficiency at the protrusion is lower than transfer efficiency at the depression in the first transfer operation.

5. The image forming apparatus according to claim 1, wherein the colored image is at least one of a yellow toner image, a magenta toner image, and a cyan toner image.

6. The image forming apparatus according to claim 1, wherein the transfer section is configured to sequentially perform the first transfer operation and the second transfer operation on the the same medium.

7. The image forming apparatus according to claim 1, wherein the transfer section is configured to perform the second transfer operation so as to transfer the second developer image and the third developer image onto the first developer image fixed to the medium.

8. An image forming method including:

performing a first image forming operation that forms a first developer image being a first transparent image or a white image, performing a second image forming operation that sequentially forms a second developer image and a third developer image, the second developer image being a colored image, the third developer image being a second transparent image, performing a first transfer operation at a first transfer voltage that transfers the first developer image onto a medium before the image forming section performs the second image forming operation; and performing a second transfer operation at a second transfer voltage that transfers the second developer image and the third developer image onto the first developer image having been transferred onto the medium to allow the second developer image and the third developer image to be stacked in this order on the first developer image having been transferred onto the medium, an absolute value of the first transfer voltage is higher than an absolute value of the second transfer voltage.

* * * * *